US011499296B2

(12) United States Patent
Kai et al.

(10) Patent No.: US 11,499,296 B2
(45) Date of Patent: Nov. 15, 2022

(54) CONSTRUCTION MACHINE

(71) Applicant: Hitachi Construction Machinery Co., Ltd., Tokyo (JP)

(72) Inventors: Takamasa Kai, Tokyo (JP); Juri Shimizu, Tokyo (JP); Kenji Hiraku, Tsuchiura (JP); Hiromasa Takahashi, Tsuchiura (JP); Teppei Saitou, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 17/417,812

(22) PCT Filed: Feb. 12, 2020

(86) PCT No.: PCT/JP2020/005263
§ 371 (c)(1),
(2) Date: Jun. 24, 2021

(87) PCT Pub. No.: WO2020/175132
PCT Pub. Date: Sep. 3, 2020

(65) Prior Publication Data

US 2022/0074170 A1 Mar. 10, 2022

(30) Foreign Application Priority Data

Feb. 28, 2019 (JP) ..... JP2019-035774

(51) Int. Cl.
*E02F 9/22* (2006.01)
*E02F 9/20* (2006.01)
(Continued)

(52) U.S. Cl.
CPC ..... *E02F 9/2228* (2013.01); *E02F 9/2004* (2013.01); *E02F 9/2203* (2013.01);
(Continued)

(58) Field of Classification Search
CPC ..... E02F 9/2239; E02F 9/2242; E02F 9/2292; E02F 9/2289; F15B 2211/61;
(Continued)

(56) References Cited

U.S. PATENT DOCUMENTS 6,244,048 B1 * 6/2001 Tanaka ..... E02F 9/2242 60/421
10,184,225 B2 * 1/2019 Hiraku ..... E02F 9/2292
(Continued)

FOREIGN PATENT DOCUMENTS

EP 3 176 444 A1 6/2017
JP 2015-48899 A 3/2015
(Continued)

OTHER PUBLICATIONS

International Preliminary Report on Patentability (PCT/IB/338 & PCT/IB/373) issued in PCT Application No. PCT/JP2020/005263 dated Sep. 10, 2021, including English translation (Japanese-language Written Opinion (PCT/ISA/237) filed on Jun. 24, 2021) (nine (9) pages).
(Continued)

*Primary Examiner* — Dustin T Nguyen
*Assistant Examiner* — Michael Quandt
(74) *Attorney, Agent, or Firm* — Crowell & Moring LLP

(57) ABSTRACT

To provide a construction machine that has a hydraulic system mounted thereon in which a closed-circuit pump, and an open-circuit pump and a proportional valve are arranged as a pair, and that makes it possible to use an unused open-circuit pump or proportional valve to accelerate the speed of a single rod hydraulic cylinder when the single rod hydraulic cylinder and a hydraulic motor are driven simultaneously. A controller (51) controls a cap-side selector valve (46) and a rod-side selector valve (47) such that a particular open-circuit pump (15) not connected to a single
(Continued)

rod hydraulic cylinder (3) is connected to the single rod hydraulic cylinder, and controls an opening area of a particular proportional valve (49) provided on a flow line that connects a delivery port of the particular open-circuit pump to a tank, when the single rod hydraulic cylinder and a hydraulic motor (7) are driven simultaneously.

3 Claims, 10 Drawing Sheets

(51) Int. Cl.
*F15B 13/02* (2006.01)
*F15B 13/04* (2006.01)

(52) U.S. Cl.
CPC ..... *E02F 9/2242* (2013.01); *E02F 9/2267* (2013.01); *E02F 9/2271* (2013.01); *E02F 9/2292* (2013.01); *F15B 13/024* (2013.01); *F15B 13/0416* (2013.01); *E02F 9/2296* (2013.01); *F15B 2211/20561* (2013.01); *F15B 2211/20576* (2013.01); *F15B 2211/30565* (2013.01); *F15B 2211/50536* (2013.01); *F15B 2211/613* (2013.01); *F15B 2211/7053* (2013.01); *F15B 2211/7058* (2013.01); *F15B 2211/7135* (2013.01); *F15B 2211/785* (2013.01)

(58) Field of Classification Search
CPC ..... F15B 2211/613; F15B 2211/20576; F15B 2211/785; F15B 2211/50536; F15B 2211/45; F15B 11/17; F15B 11/165
See application file for complete search history.

(56) References Cited

U.S. PATENT DOCUMENTS

| | | | | |
|---|---|---|---|---|
| 2015/0066313 | A1 | 3/2015 | Hirozawa et al. | |
| 2016/0032565 | A1* | 2/2016 | Shimizu ..... | E02F 9/2242 60/420 |

FOREIGN PATENT DOCUMENTS

| | | | |
|---|---|---|---|
| JP | 2016-145603 | A | 8/2016 |
| WO | WO 2013/145528 | A1 | 10/2013 |

OTHER PUBLICATIONS

International Search Report (PCT/ISA/210) issued in PCT Application No. PCT/JP2020/005263 dated Apr. 21, 2020 with English translation (six (6) pages).
Japanese-language Written Opinion (PCT/ISA/237) issued in PCT Application No. PCT/JP2020/005263 dated Apr. 21, 2020 (four (4) pages).
Extended European Search Report issued in European Application No. 20762036.0 dated Jun. 28, 2022 (eight (8) pages).

* cited by examiner

CONSTRUCTION MACHINE

TECHNICAL FIELD

The present invention relates to a construction machine such as a hydraulic excavator.

BACKGROUND ART

In the field of construction machines such as hydraulic excavators, the majority of construction machines uses hydraulic circuits (hereinafter, referred to as "open circuits") that cause a return oil from hydraulic actuators such as hydraulic cylinders to return to a hydraulic operating fluid tank. However, in recent years, for reduction of fuel consumption amounts, circuits (hereinafter, referred to as "closed circuits") in which the number of restricting elements in hydraulic circuits of hydraulic cylinders (hereinafter, referred to as "cylinders") or pumps, and a hydraulic motor is reduced, a return oil from the cylinders or the hydraulic motor is caused to return to a bidirectionally tiltable pump (hereinafter, referred to as a "pump"), and the pumps and the cylinders, or the pumps and the hydraulic motor are connected to each other such that closed circuits are formed are under development. In addition, a hydraulic circuit in which open circuits and closed circuits are provided in combination has been proposed also (e.g. Patent Document 1).

Patent Document 1 describes a driving device for a work machine, the driving device including: a plurality of closed circuits including at least one closed-circuit hydraulic operating fluid outflow/inflow control section having two outflow/inflow ports enabling the outflow/inflow of hydraulic operating fluid in both directions and at least one single rod hydraulic cylinder having a first hydraulic operating fluid chamber and a second hydraulic operating fluid chamber, the two outflow/inflow ports of the closed-circuit hydraulic operating fluid outflow/inflow control section being connected to the first hydraulic operating fluid chamber and the second hydraulic operating fluid chamber such that the closed circuits are formed; a plurality of open circuits including at least one open-circuit hydraulic operating fluid outflow/inflow control section having an inflow port through which the hydraulic operating fluid flows from a hydraulic operating fluid tank, and an outflow port through which the hydraulic operating fluid flows out, and an open-circuit selecting section that selects supply destinations of the hydraulic operating fluid flowing out from the open-circuit hydraulic operating fluid outflow/inflow control section; and a controller that controls the closed-circuit hydraulic operating fluid outflow/inflow control section, the open-circuit hydraulic operating fluid outflow/inflow control section and the open-circuit selecting section, and the driving device includes a connection line connected to a side from which the hydraulic operating fluid flows out, of the at least one open-circuit selecting section of the plurality of open circuits, and to any of the plurality of closed circuits.

PRIOR ART DOCUMENT

Patent Document

Patent Document 1: JP-2015-48899-A

SUMMARY OF THE INVENTION

Problem to be Solved by the Invention

In Patent Document 1, by arranging, as a pair, a closed-circuit pump, and an open-circuit pump and a proportional valve, when a hydraulic cylinder is driven in the extending direction by the closed-circuit pump, the hydraulic cylinder can be supplemented by the open-circuit pump with an amount of the hydraulic operating fluid corresponding to a deficiency generated by a pressure-receiving area difference of the hydraulic cylinder, and when the hydraulic cylinder is driven in the contracting direction by the closed-circuit pump, an amount of the hydraulic operating fluid corresponding to a surplus generated by the pressure-receiving area difference of the hydraulic cylinder can be discharged to a tank via the proportional valve. On the other hand, since a hydraulic motor does not have a pressure-receiving area difference unlike the hydraulic cylinder, when the hydraulic motor is driven, only the closed-circuit pump is used, and the open-circuit pump and the proportional valve, which form a pair with the closed-circuit pump, are left unused. However, when the speed of the hydraulic cylinder is desired to be accelerated at the time of combined operation in which the hydraulic cylinder and the hydraulic motor are driven simultaneously, the open-circuit pump and the proportional valve cannot be used despite the fact that there are those unused open-circuit pump and proportional valve.

The present invention has been made in view of the problem described above, and an object of the present invention is to provide a construction machine that has a hydraulic system mounted thereon in which a closed-circuit pump, and an open-circuit pump and a proportional valve are arranged as a pair, and that can use an unused open-circuit pump or proportional valve to accelerate the speed of a hydraulic cylinder when the hydraulic cylinder and a hydraulic motor are driven simultaneously.

Means for Solving the Problem

In order to achieve the object described above, the present invention provides a construction machine including: a tank that stores hydraulic operating fluid; a plurality of closed-circuit pumps including bidirectionally-tiltable hydraulic pumps; a plurality of open-circuit pumps including unidirectionally-tiltable hydraulic pumps, the number of the unidirectionally-tiltable hydraulic pumps being the same as the number of the plurality of closed-circuit pumps; a plurality of hydraulic actuators including at least one single rod hydraulic cylinder, and at least one hydraulic motor; an operation device for giving an instruction about operation of the plurality of hydraulic actuators; a plurality of closed-circuit selector valves that connect the plurality of closed-circuit pumps to the plurality of hydraulic actuators such that closed circuits are formed; a plurality of cap-side selector valves that connect delivery ports of the plurality of open-circuit pumps to a cap chamber of the single rod hydraulic cylinder; a plurality of proportional valves that are provided on flow lines that connect the delivery ports of the plurality of open-circuit pumps to the tank; a cap pressure sensor that senses a pressure in the cap chamber; a rod pressure sensor that senses a pressure in a rod chamber of the single rod hydraulic cylinder; and a controller that controls the plurality of closed-circuit selector valves, and the plurality of cap-side selector valves, and controls a delivery flow rate of each of the plurality of closed-circuit pumps and the plurality of open-circuit pumps, and opening areas of the plurality of proportional valves, on the basis of inputs from the operation device, the cap pressure sensor and the rod pressure sensor. In the construction machine, the construction machines includes a plurality of rod-side selector valves that connect the delivery ports of the plurality of open-circuit pumps to the rod chamber, and the controller controls the plurality of cap-side selector valves and the plurality of rod-side selector valves such that a particular open-circuit pump in the plurality of open-circuit pumps that is not connected to the single rod hydraulic cylinder is connected to the single rod hydraulic cylinder, and controls an opening area of a particular proportional valve provided on a flow line that connects a delivery port of the particular open-circuit pump to the tank, when the single rod hydraulic cylinder and the hydraulic motor are driven simultaneously.

According to the thus-configured present invention, when the single rod hydraulic cylinder and the hydraulic motor are driven simultaneously, the particular open-circuit pump not connected to the single rod hydraulic cylinder, and the particular proportional valve are connected to the single rod hydraulic cylinder, and the opening area of the particular proportional valve (unused proportional valve) provided on the flow line that connects the delivery port of the particular open-circuit pump to the tank is controlled. Thereby, when the single rod hydraulic cylinder and the hydraulic motor are driven simultaneously, it becomes possible to use the unused open-circuit pump or the unused proportional valve to accelerate the speed of the single rod hydraulic cylinder.

Advantages of the Invention

According to the present invention, in a construction machine that has a hydraulic system mounted thereon in which a closed-circuit pump, and an open-circuit pump and a proportional valve are arranged as a pair, it becomes possible to use an unused open-circuit pump or an unused proportional valve to accelerate the speed of a single rod hydraulic cylinder when the single rod hydraulic cylinder and a hydraulic motor are driven simultaneously.

BRIEF DESCRIPTION OF THE DRAWINGS

FIG. 7B is executed.

MODES FOR CARRYING OUT THE INVENTION

Figure 1:
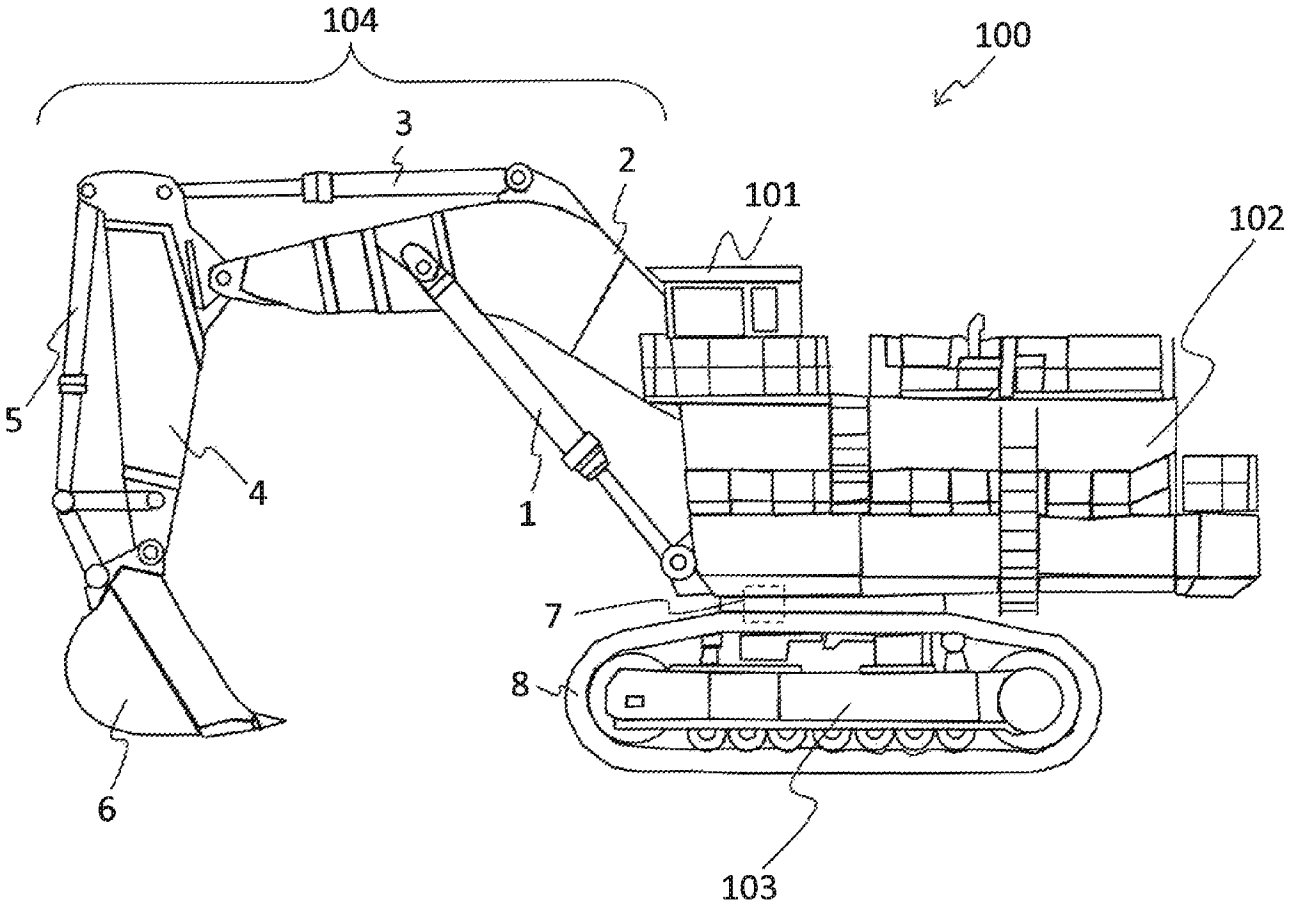
FIG. 1 is a side view of a hydraulic excavator as one example of a construction machine according to a first embodiment of the present invention.

In the following, a hydraulic excavator as an example of a construction machine according to embodiments of the present invention is explained with reference to the figures. Note that equivalent members in the figures are given identical reference characters, and overlapping explanations are omitted as appropriate.

First Embodiment

A hydraulic excavator according to a first embodiment of the present invention is explained by using FIG. 1 to FIG. 5.

FIG. 1 is a side view of the hydraulic excavator according to the first embodiment of the present invention.

In FIG. 1, a hydraulic excavator 100 includes: a lower travel structure 103 including crawler-type travel devices 8 on both left and right sides; and an upper swing structure 102 swingably attached onto the lower travel structure 103. The upper swing structure 102 is driven by a swing motor 7, which is a hydraulic motor.

On the front side of the upper swing structure 102, a base end section of a front work implement 104, which is a work device for performing excavation work and the like, for example, is attached pivotably. The front work implement 104 includes: a boom 2 coupled on the front side of the upper swing structure 102 so as to be pivotable upward and downward; an arm 4 coupled at a tip section of the boom 2 so as to be pivotable upward, downward, forward and backward; and a bucket 6 coupled at a tip section of the arm 4 so as to be pivotable upward, downward, forward and backward. The boom 2, the arm 4 and the bucket 6 are driven by a boom cylinder 1, an arm cylinder 3 and a bucket cylinder 5, respectively, which are single rod hydraulic cylinders.

A cab 101, which an operator gets on, is provided on the upper swing structure 102. A lever 52 (illustrated in FIG. 2) for operating the boom 2, the arm 4, the bucket 6, and the upper swing structure 102 is arranged in the cab 101.

Figure 2:
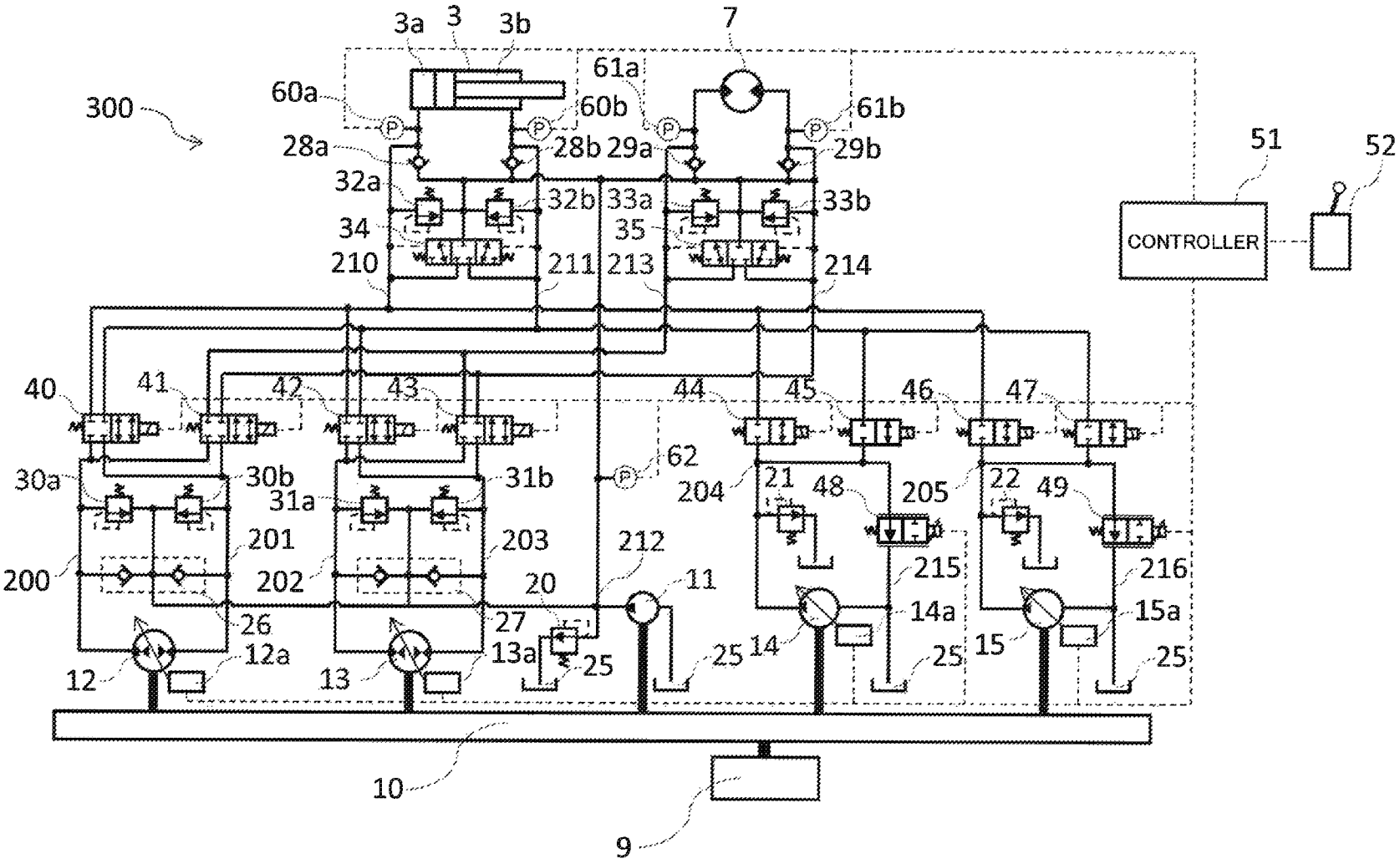
FIG. 2 is a schematic configuration diagram of a hydraulic system mounted on the hydraulic excavator illustrated in FIG. 1.

FIG. 2 is a schematic configuration diagram of a hydraulic system mounted on the hydraulic excavator 100 illustrated in FIG. 1. Note that, for simplification of explanations, only sections related to the driving of the arm cylinder 3 and the swing motor 7 are illustrated in FIG. 2, and sections related to the driving of the other actuators are omitted.

In FIG. 2, a hydraulic system 300 includes: the arm cylinder 3; the swing motor 7; the lever 52 as an operation device that gives instructions about the operation directions and demanded speeds of the arm cylinder 3 and the swing motor; an engine 9, which is a motive power source; a power transmission device 10 that distributes motive power of the engine 9; bidirectionally-tiltable hydraulic pumps (hereinafter, closed-circuit pumps) 12 and 13, unidirectionally-tiltable hydraulic pumps (hereinafter, open-circuit pumps) 14 and 15, and a charge pump 11 that are driven by motive power distributed by the power transmission device 10; selector valves 40 to 47 that can select connections between the hydraulic pumps 12 to 15 and the hydraulic actuators 3 and 7; proportional valves 48 and 49; and a controller 51.

The engine 9, which is a motive power source, is connected to the power transmission device 10 that distributes motive power. The power transmission device 10 is connected with the charge pump 11, the closed-circuit pumps 12 and 13, and the open-circuit pumps 14 and 15.

The closed-circuit pumps 12 and 13 include: bidirectionally-tiltable swash plate mechanisms each having a pair of input/output ports; and regulators 12*a* and 13*a* that adjust the tilting angles of bidirectionally-tiltable swash plates. The regulators 12*a* and 13*a* adjust the tilting angles of the bidirectionally-tiltable swash plates of the closed-circuit pumps 12 and 13 according to signals from the controller 51. The closed-circuit pumps 12 and 13 can control the delivery directions and delivery flow rates of hydraulic operating fluid from the pairs of input/output ports by adjusting the tilting angles of the swash plates. The closed-circuit pumps 12 and 13 function also as hydraulic motors when supplied with the hydraulic fluid.

The open-circuit pumps 14 and 15 include: unidirectionally-tiltable swash plate mechanisms having delivery ports and suction ports; and regulators 14*a* and 15*a* that adjust tilting angles of unidirectionally-tiltable swash plates. The regulators 14*a* and 15*a* adjust the tilting angles of the unidirectionally-tiltable swash plates of the open-circuit pumps 14 and 15 according to signals from the controller 51. The open-circuit pumps 14 and 15 can control the delivery flow rates of the hydraulic operating fluid from the delivery ports by adjusting the tilting angles of the unidirectionally-tiltable swash plates.

The charge pump 11 supplements a flow line 212 as a charge line with the hydraulic fluid.

The pair of input/output ports of the closed-circuit pump 12 are connected with flow lines 200 and 201, and the flow lines 200 and 201 are connected with the selector valves 40 and 41. The selector valves 40 and 41 select communication or interruption of the flow lines according to signals from the controller 51. When there are no signals from the controller 51, the selector valves 40 and 41 are in the interruption state.

The selector valve 40 is connected to a cap chamber 3*a* of the arm cylinder 3 via a flow line 210, and is connected to a rod chamber 3*b* of the arm cylinder 3 via a flow line 211. When the selector valve 40 is in the communication state according to a signal from the controller 51, the closed-circuit pump 12 is connected with the arm cylinder 3 via the flow lines 200 and 201, the selector valve 40, and the flow lines 210 and 211, to thereby form a closed circuit.

The selector valve 41 is connected to one input/output port of the swing motor 7 via a flow line 213, and is connected to the other input/output port of the swing motor 7 via a flow line 214. When the selector valve 41 is in the communication state in accordance with a signal from the controller 51, the closed-circuit pump 12 is connected with the swing motor 7 via the flow lines 200 and 201, the selector valve 41, and the flow lines 213 and 214, to thereby form a closed circuit.

The pair of input/output ports of the closed-circuit pump 13 are connected with flow lines 202 and 203, and the flow lines 202 and 203 are connected with the selector valves 42 and 43. The selector valves 42 and 43 select communication or interruption of the flow lines according to signals from the controller 51. When there are no signals from the controller 51, the selector valves 42 and 43 are in the interruption state.

The selector valve 42 is connected to the cap chamber 3*a* of the arm cylinder 3 via the flow line 210, and is connected to the rod chamber 3*b* of the arm cylinder 3 via the flow line 211. When the selector valve 42 is in the communication state according to a signal from the controller 51, the closed-circuit pump 13 is connected with the arm cylinder 3 via the flow lines 202 and 203, the selector valve 42, and the flow lines 210 and 211, to thereby form a closed circuit.

The selector valve 43 is connected to the one input/output port of the swing motor 7 via the flow line 213, and is connected to the other input/output port of the swing motor 7 via the flow line 214. When the selector valve 43 is in the communication state according to a signal from the controller 51, the closed-circuit pump 13 is connected with the swing motor 7 via the flow lines 202 and 203, the selector valve 43, and the flow lines 213 and 214, to thereby form a closed circuit.

The delivery port of the open-circuit pump 14 is connected to the selector valves 44 and 45 and a relief valve 21 via a flow line 204. The proportional valve 48 is provided on a flow line 215 that connects the delivery port of the open-circuit pump 14 to a tank 25. The suction port of the open-circuit pump 14 is connected to the tank 25.

When a flow-line pressure becomes a predetermined pressure or higher, the relief valve 21 vents the hydraulic operating fluid to the tank 25, and protects the circuit.

The selector valves 44 and 45 select communication or interruption of the flow lines according to signals from the controller 51. When there are no signals from the controller 51, the selector valves 44 and 45 are in the interruption state.

The selector valve 44 is connected to the cap chamber 3*a* of the arm cylinder 3 via the flow line 210.

The selector valve 45 is connected to the rod chamber 3*b* of the arm cylinder 3 via the flow line 211.

The proportional valve 48 changes the opening area and controls the passing flow rate according to a signal from the controller 51. When there are no signals from the controller 51, the proportional valve 48 is kept at the maximum opening area. In addition, when the selector valves 44 and 45 are in the interruption state, the controller 51 controls the delivery flow rate of the open-circuit pump 14 such that it becomes the minimum flow rate, and opens the proportional valve 49 minutely such that the hydraulic operating fluid is discharged to the tank 25 at that minimum flow rate.

The delivery port of the open-circuit pump 15 is connected to the selector valves 46 and 47 and a relief valve 22 via a flow line 205. The proportional valve 49 is provided on a flow line 216 that connects the delivery port of the open-circuit pump 15 to the tank 25. The suction port of the open-circuit pump 15 is connected to the tank 25.

The relief valve 22 vents the hydraulic operating fluid to the tank 25 and protects the circuit when a flow-line pressure becomes a predetermined pressure or higher.

The selector valves 46 and 47 select communication or interruption of the flow lines according to signals from the controller 51. When there are no signals from the controller 51, the selector valves 46 and 47 are in the interruption state.

The selector valve 46 is connected to the cap chamber 3*a* of the arm cylinder 3 via the flow line 210.

The selector valve 47 is connected to the rod chamber 3*b* of the arm cylinder 3 via the flow line 213.

The proportional valve 49 changes the opening area and controls the passing flow rate according to a signal from the controller 51. When there are no signals from the controller 51, the proportional valve 49 is kept at the maximum opening area. In addition, when the selector valves 46 and 47 are in the interruption state, the controller 51 controls the delivery flow rate of the open-circuit pump 15 such that it becomes the minimum flow rate, and opens the proportional valve 49 minutely such that the hydraulic operating fluid is discharged to the tank 25 at that minimum flow rate.

The delivery port of the charge pump 11 is connected to a charge relief valve 20, and charge check valves 26, 27, 28*a*, 28*b*, 29*a*, and 29*b* via the charge line 212.

The suction port of the charge pump 11 is connected to the tank 25.

The charge relief valve 20 sets a charge pressure of the charge check valves 26, 27, 28*a*, 28*b*, 29*a*, and 29*b*.

The charge check valve 26 opens and supplements the flow lines 200 and 201 with the hydraulic fluid in the charge pump 11 when the pressures in the flow lines 200 and 201 fall below the charge pressure set at the charge relief valve 20.

The charge check valve 27 opens and supplements the flow lines 202 and 203 with the hydraulic fluid in the charge pump 11 when the pressures in the flow lines 202 and 203 fall below the charge pressure set at the charge relief valve 20.

The charge check valves 28*a* and 28*b* open and supplement the flow lines 210 and 211 with the hydraulic fluid in the charge pump 11 when the pressures in the flow lines 210 and 211 fall below the charge pressure set at the charge relief valve 20.

The charge check valves 29*a* and 29*b* open and supplement the flow lines 213 and 214 with the hydraulic fluid in the charge pump 11 when the pressures in the flow lines 213 and 214 fall below the charge pressure set at the charge relief valve 20.

Relief valves 30*a* and 30*b* provided on the flow lines 200 and 201 vent the hydraulic operating fluid to the charge line 212 and protect the circuit when a flow-line pressure becomes a predetermined pressure or higher.

Relief valves 31*a* and 31*b* provided on the flow lines 202 and 203 vent the hydraulic operating fluid to the charge line 212 and protect the circuit when a flow-line pressure becomes a predetermined pressure or higher.

The arm cylinder 3 is a single rod hydraulic cylinder that performs extension/contraction operation by being supplied with the hydraulic operating fluid. The extension/contracting direction of the arm cylinder 3 depends on the direction of supply of the hydraulic operating fluid.

Relief valves 32*a* and 32*b* provided on the flow lines 210 and 211 vent the hydraulic operating fluid to the charge line 212 and protect the circuit when a flow-line pressure becomes a predetermined pressure or higher.

A flushing valve 34 provided on the flow lines 210 and 211 discharges a surplus oil in the flow lines to the charge line 212.

The swing motor 7 is a hydraulic motor that is pivoted by being supplied with the hydraulic operating fluid. The pivot direction of the swing motor 7 depends on the direction of supply of the hydraulic operating fluid.

Relief valves 33*a* and 33*b* provided on the flow lines 213 and 214 vent the hydraulic operating fluid to the charge line 212 and protect the circuit when a flow-line pressure becomes a predetermined pressure or higher.

A flushing valve 35 provided on the flow lines 210 and 211 discharges a surplus oil in the flow lines to the charge line 212.

A pressure sensor 60*a* connected to the flow line 210 senses the pressure in the flow line 210 and inputs the sensed pressure to the controller 51. The pressure sensor 60*a* senses the pressure in the cap chamber 3*a* of the arm cylinder 3 by sensing the pressure in the flow line 210.

A pressure sensor 60*b* connected to the flow line 211 senses the pressure in the flow line 211 and inputs the sensed pressure to the controller 51. The pressure sensor 60*b* senses the pressure in the rod chamber 3*b* of the arm cylinder 3 by sensing the pressure in the flow line 211.

A pressure sensor 61*a* connected to the flow line 213 senses the pressure in the flow line 213 and inputs the sensed pressure to the controller 51. The pressure sensor 61*a* senses the pressure in the one input/output port of the swing motor 7 by sensing the pressure in the flow line 213.

A pressure sensor 61*b* connected to the flow line 214 senses the pressure in the flow line 214 and inputs the sensed pressure to the controller 51. The pressure sensor 61*b* senses the pressure in the other input/output port of the swing motor 7 by sensing the pressure in the flow line 214.

The lever 52 inputs an amount of lever operation by an operator to the controller 51.

Figure 3:
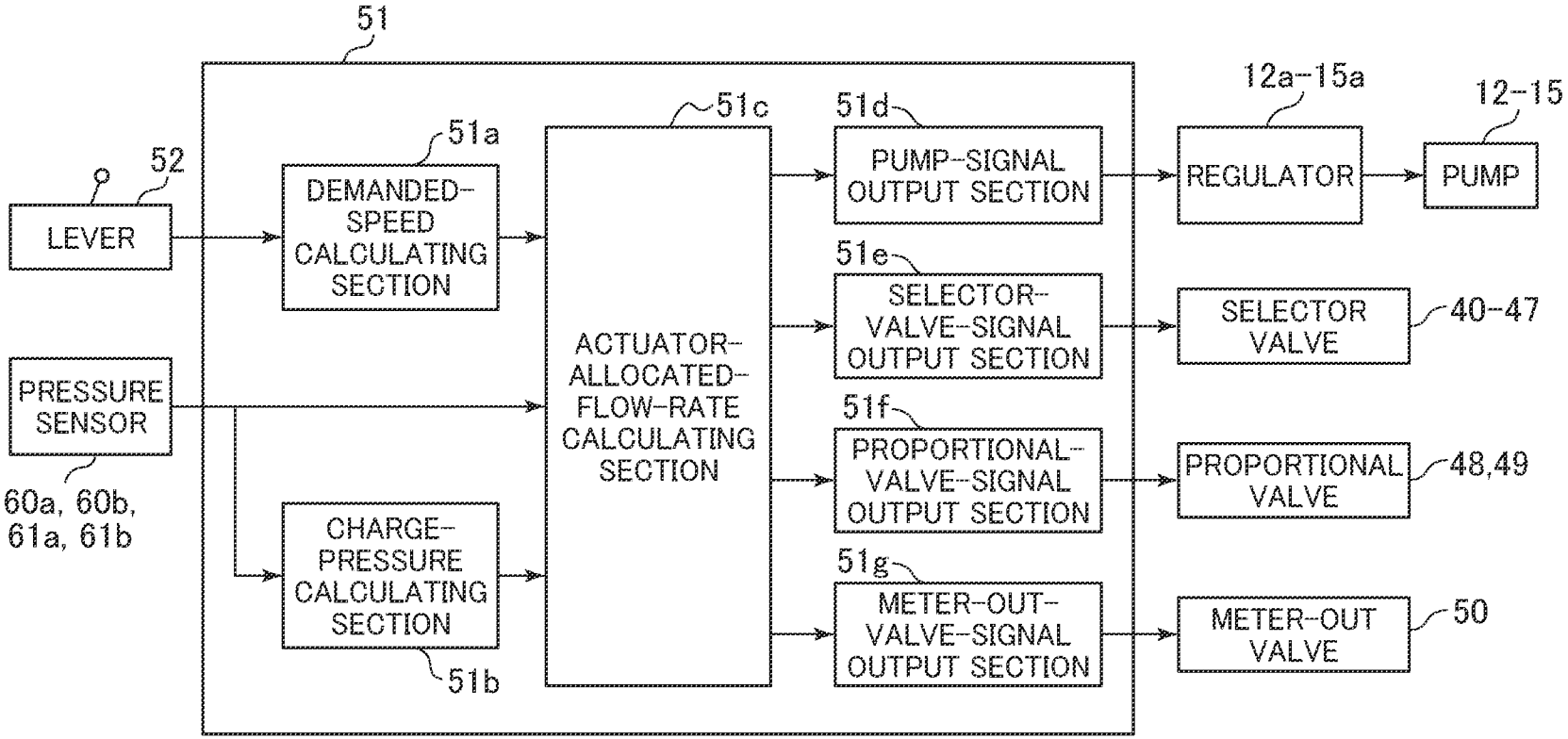
FIG. 3 is a functional block diagram of a controller illustrated in FIG. 2.

FIG. 3 illustrates functional blocks of the controller 51. The controller 51 includes a demanded-speed calculating section 51*a*, a charge-pressure calculating section 51*b*, an actuator-allocated-flow-rate calculating section 51*c*, a pump-signal output section 51*d*, a selector-valve-signal output section 51*e*, a proportional-valve-signal output section 51*f*, and a meter-out-valve-signal output section 51*g*.

The demanded-speed calculating section 51*a* calculates, from an input of the lever 52, operation directions and demanded speeds of actuators, and inputs a control signal to the actuator-allocated-flow-rate calculating section 51*c*.

The charge-pressure calculating section 51*b* calculates a charge pressure on the basis of values of inputs from the pressure sensors 60*a*, 60*b*, 61*a*, and 61*b*, and inputs a control signal to the actuator-allocated-flow-rate calculating section 51*c*.

The actuator-allocated-flow-rate calculating section 51*c* calculates the number of pumps necessary for the driving of each actuator on the basis of the control signal from the demanded-speed calculating section 51*a*, the values of inputs from the pressure sensors 60*a*, 60*b*, 61*a*, and 61*b*, and the control signal from the charge-pressure calculating section 51*b*, and inputs a control signal to the pump-signal output section 51*d*. Simultaneously, in order to form a flow line for driving each actuator, the actuator-allocated-flow-rate calculating section 51*c* inputs control signals to the selector-valve-signal output section 51*e*, the proportional-valve-signal output section 51*f*, and the meter-out-valve-signal output section 51*g*.

The pump-signal output section 51*d* outputs signals to the regulators 12*a* to 15*a* on the basis of the control signal from the actuator-allocated-flow-rate calculating section 51*c*.

The selector-valve-signal output section 51*e* outputs signals to the selector valves 40 to 47 on the basis of the control signal from the actuator-allocated-flow-rate calculating section 51*c*.

The proportional-valve-signal output section 51*f* outputs signals to the proportional valves 48 and 49 on the basis of the control signal from the actuator-allocated-flow-rate calculating section 51*c*.

The meter-out-valve-signal output section 51*g* outputs a signal to a meter-out valve 50 on the basis of the control signal from the actuator-allocated-flow-rate calculating section 51*c*.

Figure 4A:
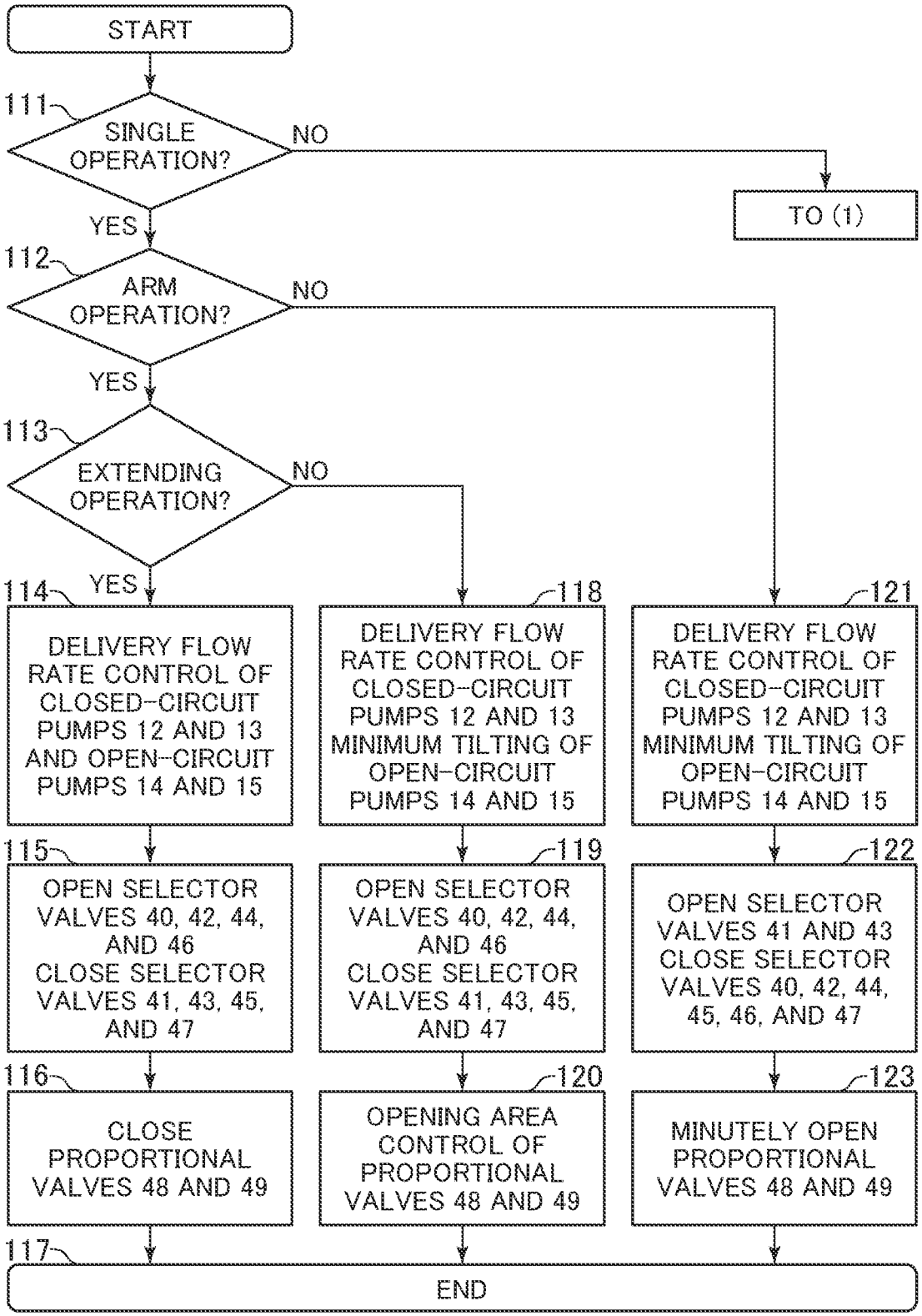
FIG. 4A is a figure (1/2) illustrating a control flow of an actuator-allocated-flow-rate calculating section illustrated in FIG. 3.
Figure 4B:
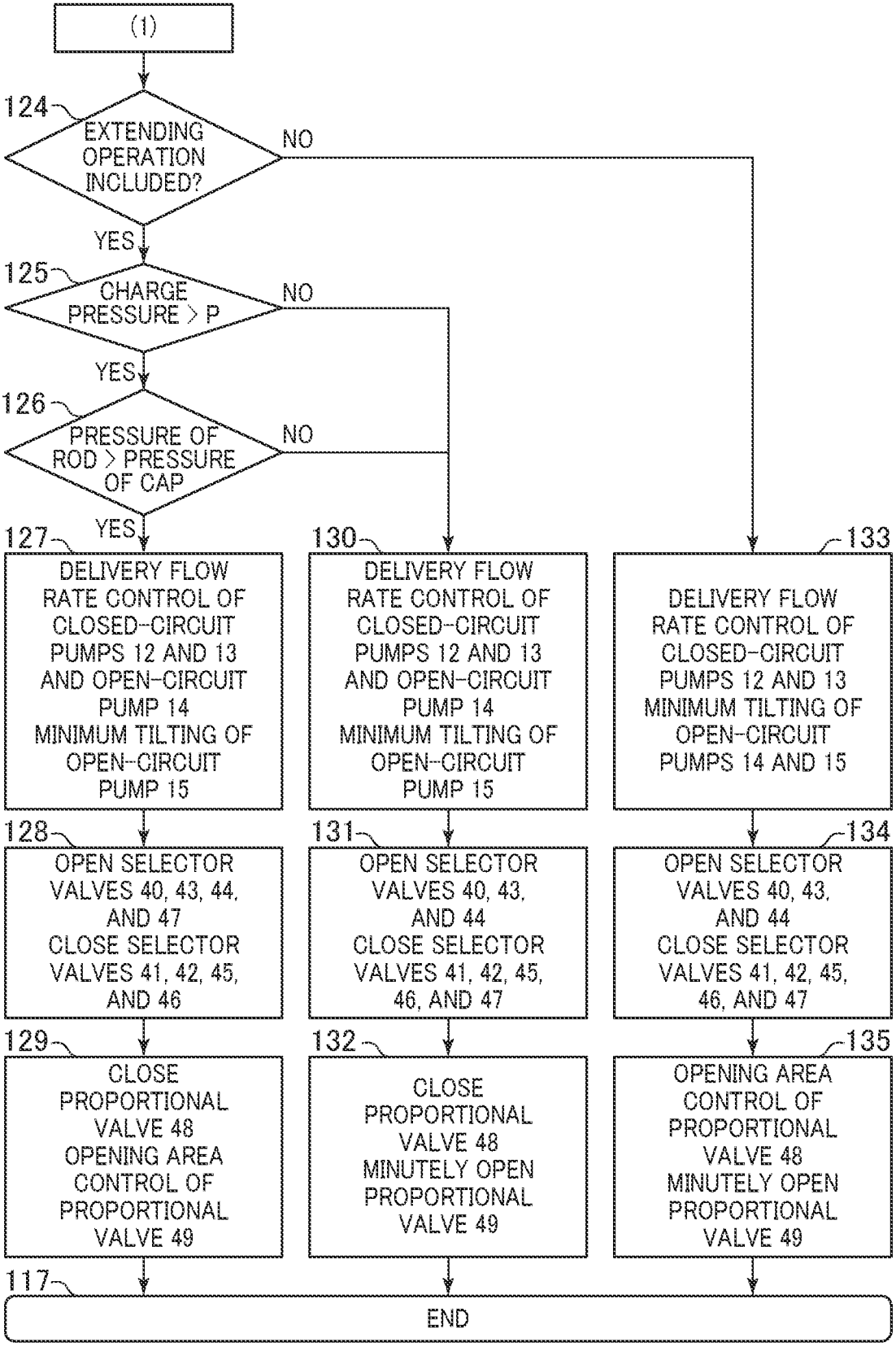
FIG. 4B is a figure (2/2) illustrating the control flow of the actuator-allocated-flow-rate calculating section illustrated in FIG. 3.

FIG. 4A and FIG. 4B illustrate a control flow in the actuator-allocated-flow-rate calculating section 51*c*.

When input of operation through the lever 52 is started, it is determined whether or not the operation is single operation at Step 111. When the operation is single operation, it is determined whether or not the operation is arm operation at Step 112. When the operation is arm operation, it is determined whether or not the operation is arm-extending operation at Step 113. When the operation is arm-extending operation, at Step 114, the delivery flow rates of the closed-circuit pumps 12 and 13, and the open-circuit pumps 14 and 15 are controlled. At Step 115, the selector valves 40, 42, 44, and 46 are opened, and the selector valves 41, 43, 45, and 47 are closed. At Step 116, the proportional valves 48 and 49 are closed, and the flow ends at Step 117.

As a result of Steps 114 to 116, the hydraulic operating fluid delivered from the closed-circuit pumps 12 and 13 and the open-circuit pumps 14 and 15 is supplied to the cap chamber 3*a* of the arm cylinder 3, the hydraulic operating fluid discharged from the rod chamber 3*b* of the arm cylinder 3 is absorbed by the closed-circuit pumps 12 and 13, and the arm cylinder 3 performs extending operation.

When it is determined at Step 113 that the operation is not arm-extending operation (i.e. the operation is arm-contracting operation), at Step 118, the delivery flow rates of the closed-circuit pumps 12 and 13 are controlled, and the delivery flow rates of the open-circuit pumps 14 and 15 are controlled such that the tilting amounts are minimized. At Step 119, the selector valves 40, 42, 44, and 46 are opened, and the selector valves 41, 43, 45, and 47 are closed. At Step 120, the opening areas of the proportional valves 48 and 49 are controlled, and the flow ends at Step 117.

As a result of Steps 118 to 120, the hydraulic operating fluid delivered from the closed-circuit pumps 12 and 13 is supplied to the rod chamber 3*b* of the arm cylinder 3, part of the hydraulic operating fluid discharged from the cap chamber 3*a* of the arm cylinder 3 is absorbed by the closed-circuit pumps 12 and 13, remaining part of the hydraulic operating fluid is discharged to the tank 25 via the proportional valves 48 and 49, and the arm cylinder 3 performs contracting operation.

When it is determined at Step 112 that the operation is not arm operation (i.e. the operation is swing single operation), at Step 121, the delivery flow rates of the closed-circuit pumps 12 and 13 are controlled, and the delivery flow rates of the open-circuit pumps 14 and 15 are controlled such that the tilting amounts are minimized. At Step 122, the selector valves 41 and 43 are opened, and the selector valves 40, 42, 44, 45, 46, and 47 are closed. At Step 123, the proportional valves 48 and 49 are opened minutely, and the flow ends at Step 117.

As a result of Steps 121 to 123, the hydraulic operating fluid delivered from the closed-circuit pumps 12 and 13 is supplied to the one input/output port of the swing motor 7, the hydraulic operating fluid discharged from the other input/output port of the swing motor 7 is absorbed by the closed-circuit pumps 12 and 13, and the swing motor 7 performs rotational operation.

When it is determined at Step 111 that the operation is not single operation (i.e. the operation is combined operation), it is determined whether or not the operation includes arm-extending operation at Step 124. When the operation includes arm-extending operation, it is determined whether or not the charge pressure is higher than a predetermined pressure P at Step 125. Here, the predetermined pressure P is a lower limit value of the charge pressure that can be set to any value. The predetermined pressure P is set to a value larger than zero, and smaller than the set pressure of the charge relief valve 20. More specifically, the predetermined pressure P is desirably set to such a pressure (e.g. 60% to 90% of the set pressure of the charge relief valve 20) that cavitation does not occur when the flow lines 200 to 203, 210, 211, 213, and 214 are supplemented with the hydraulic fluid via the charge check valves 26, 27, 28*a*, 28*b*, 29*a*, and 29*b*. When the charge pressure is higher than the predetermined pressure P, it is determined whether or not the pressure in the rod chamber 3*b* of the arm cylinder 3 is higher than the pressure in the cap chamber 3*a*. When it is determined that the pressure in the rod chamber 3*b* is higher, at Step 127, the delivery flow rates of the closed-circuit pumps 12 and 13 and the open-circuit pump 14 are controlled, and the delivery flow rate of the open-circuit pump 15 is controlled such that the tilting amount is minimized. At Step 128, the selector valves 40, 43, 44, and 47 are opened, and the selector valves 41, 42, 45, and 46 are closed. At Step 129, the proportional valve 48 is closed, and the opening area of the proportional valve 49 is controlled, and the flow ends at Step 117.

As a result of Steps 127 to 129, the hydraulic operating fluid is supplied from the closed-circuit pump 12 and the open-circuit pump 14 to the cap chamber 3*a* of the arm cylinder 3, part of the hydraulic operating fluid discharged from the rod chamber 3*b* of the arm cylinder 3 is absorbed by the closed-circuit pump 12, remaining part of the hydraulic operating fluid is discharged to the tank 25 via the proportional valve 49, and the arm cylinder 3 performs extending operation. Simultaneously, the hydraulic operating fluid is supplied from the closed-circuit pump 13 to the one input/output port of the swing motor 7, the hydraulic operating fluid discharged from the other input/output port of the swing motor 7 is absorbed by the closed-circuit pump 13, and the swing motor 7 performs rotational operation. At this time, the hydraulic operating fluid in the high-pressure-side rod chamber 3*b* of the arm cylinder 3 is discharged to the tank 25 via the particular proportional valve 49 corresponding to the unused open-circuit pump 15, and thus it becomes possible to accelerate the extension speed of the arm cylinder 3.

When it is determined at Step 126 that the pressure in the rod chamber 3*b* is not higher than the pressure in the cap chamber 3*a*, or when it is determined at Step 125 that the charge pressure is not higher than the predetermined pressure P, at Step 130, the delivery flow rates of the closed-circuit pumps 12 and 13 and the open-circuit pump 14 are controlled, and the delivery flow rate of the open-circuit pump 15 is controlled such that the tilting amount is minimized. At Step 131, the selector valves 40, 43, and 44 are opened, and the selector valves 41, 42, 45, 46, and 47 are closed. At Step 132, the proportional valve 48 is closed, and the proportional valve 49 is opened minutely, and the flow ends at Step 117. Thereby, the hydraulic operating fluid is supplied from the closed-circuit pump 12 and the open-circuit pump 14 to the low-pressure-side cap chamber 3*a* of the arm cylinder 3, the hydraulic operating fluid discharged from the rod chamber 3*b* of the arm cylinder 3 is absorbed by the closed-circuit pump 12, and the arm cylinder 3 performs extending operation. Simultaneously, the hydraulic operating fluid is supplied from the closed-circuit pump 13 to the one input/output port of the swing motor 7, the hydraulic operating fluid discharged from the other input/output port of the swing motor 7 is absorbed by the closed-circuit pump 13, and the swing motor 7 performs rotational operation.

When it is determined at Step 124 that the operation does not include arm-extending operation, at Step 133, the delivery flow rates of the closed-circuit pumps 12 and 13 are controlled, and the delivery flow rates of the open-circuit pumps 14 and 15 are controlled such that the tilting amounts are minimized. At Step 134, the selector valves 40, 43 and 44 are opened, and the selector valves 41, 42, 45, 46, and 47 are closed. At Step 135, the opening area of the proportional valve 48 is controlled, and the proportional valve 49 is opened minutely, and the flow ends at Step 117.

As a result of Steps 133 to 135, the hydraulic operating fluid is supplied from the closed-circuit pump 12 to the rod chamber 3*b* of the arm cylinder 3, part of the hydraulic operating fluid discharged from the cap chamber 3*a* of the arm cylinder 3 is absorbed by the closed-circuit pump 12, remaining part of the hydraulic operating fluid is discharged to the tank 25 via the proportional valve 48, and the arm cylinder 3 performs contracting operation. Simultaneously, the hydraulic operating fluid is supplied from the closed-circuit pump 13 to the one input/output port of the swing motor 7, the hydraulic operating fluid discharged from the other input/output port of the swing motor 7 is absorbed by the closed-circuit pump 13, and the swing motor 7 performs rotational operation.

Figure 5:
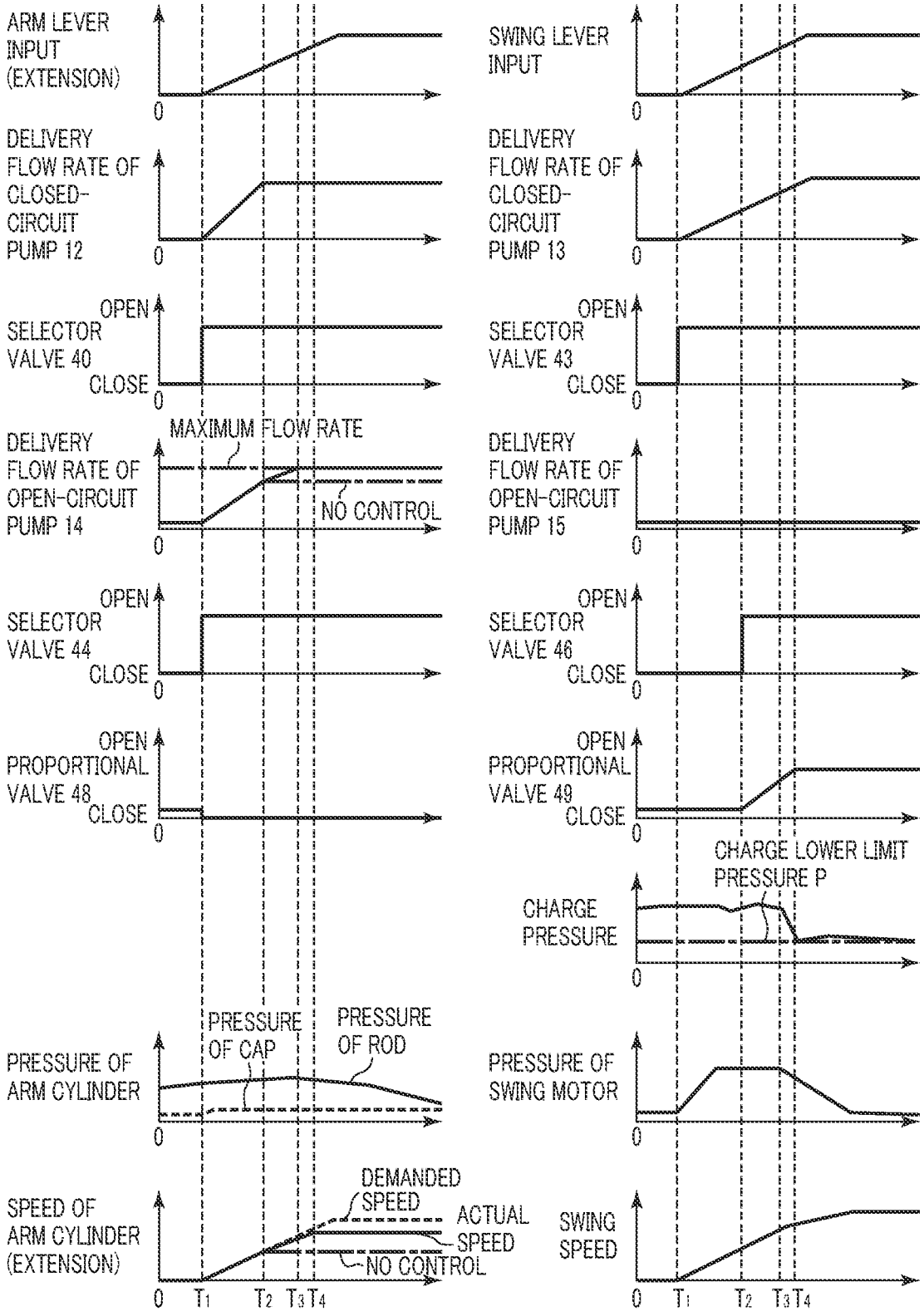
FIG. 5 is a figure illustrating operation of the hydraulic system in a case in which control illustrated in FIG. 4A and FIG. B is executed.

FIG. 5 illustrates operation of the hydraulic system 300 in a case in which the control flow illustrated in FIG. 4A and FIG. 4B is executed. FIG. 5 illustrates: input through the lever 52; the delivery flow rates of the closed-circuit pumps 12 and 13; the opened/closed states of the selector valves 40 and 43; the delivery flow rates of the open-circuit pumps 14 and 15; the opened/closed states of the selector valves 44 and 46; the openings of the proportional valves 48 and 49; the pressure in the arm cylinder 3; the pressure in the swing motor 7; the speed of the arm cylinder 3; and the speed of the swing motor 7, that are observed when dual combined operation of arm operation and swing operation is performed.

At time T1, an operator uses the lever 52 to start operation of extending the arm 4, and operation of pivoting the upper swing structure 102. From the input of the lever 52, a demanded speed is calculated, and in order to perform operation according to the demanded speed, the delivery flow rates of the closed-circuit pumps 12 and 13 increase. In order to introduce the delivery flow rates of the closed-circuit pumps 12 and 13 to the actuators, the selector valves 40 and 43 are opened. In the operation of extending the arm 4, the hydraulic operating fluid is supplied to the cap chamber of the arm cylinder 3, and the hydraulic operating fluid is discharged from the rod chamber. In order to compensate for a decrease in the hydraulic operating fluid due to the pressure-receiving area difference of the hydraulic cylinder, the delivery flow rate of the open-circuit pump 14 is controlled. The tilting angle of the open-circuit pump 15 is kept at the minimum tilting angle. In order to introduce the hydraulic operating fluid delivered by the open-circuit pump 14 to the actuators, the selector valve 44 is opened. The cap-side pressure of the arm cylinder 3 increases along with the supply of the hydraulic operating fluid.

At time T2, the delivery flow rates of the closed-circuit pumps 12 and 13 become the maximum delivery flow rates, but the speed of the arm cylinder 3 is lower than the demanded speed. In order to increase the speed of the arm cylinder 3, the hydraulic operating fluid discharged from the rod chamber of the arm cylinder 3 needs to be increased. Since the pressure in the rod chamber 3*b* of the arm cylinder 3 is higher than the pressure in the cap chamber 3*a* at this time, the speed of the arm cylinder 3 can be accelerated if the hydraulic operating fluid in the rod chamber 3*b* can be discharged to the tank 25.

At time T2, the selector valve 46 is opened, and the opening area of the proportional valve 49 is controlled to discharge the hydraulic operating fluid discharged from the rod chamber of the arm cylinder 3 to the tank 25 via the proportional valve 49. In order to prevent a decrease in the charge pressure caused by an increase in the flow rate discharged from the rod chamber of the arm cylinder 3, the delivery flow rate of the open-circuit pump 14 is increased.

At time T3, the delivery flow rate of the open-circuit pump 14 becomes the maximum delivery flow rate. Since the delivery flow rate cannot be increased by controlling the open-circuit pump 14, the opening area of the proportional valve 49 is controlled to prevent the charge pressure from falling below the charge lower limit pressure P.

At time T4, the opening of the proportional valve 49 is kept constant to perform control to prevent the charge pressure from falling below the lower limit pressure P.

By performing control in the manner mentioned above, the speed of the arm cylinder 3 can be increased, and it is possible to prevent the charge pressure from becoming a negative pressure even when the discharge flow rate of the hydraulic operating fluid in the circuit increases.

In the present embodiment, in the construction machine 100 including: the tank 25 that stores the hydraulic operating fluid; the plurality of closed-circuit pumps 12 and 13 including bidirectionally-tiltable hydraulic pumps; the plurality of open-circuit pumps 14 and 15 including unidirectionally-tiltable hydraulic pumps, the number of the unidirectionally-tiltable hydraulic pumps being the same as the number of the plurality of closed-circuit pumps 12 and 13; the plurality of hydraulic actuators 3 and 7 including the at least one single rod hydraulic cylinder 3 and the at least one hydraulic motor 7; the operation device 52 for giving instructions about operation of the plurality of hydraulic actuators 3 and 7; the plurality of closed-circuit selector valves 40 to 43 that connect the plurality of closed-circuit pumps 12 and 13 to the plurality of hydraulic actuators 3 and 7 such that closed circuits are formed; the plurality of cap-side selector valves 44 and 46 that connect the delivery ports of the plurality of open-circuit pumps 14 and 15 to the cap chamber 3*a* of the single rod hydraulic cylinder 3; the plurality of proportional valves 48 and 49 that are provided on the flow lines 215 and 216 that connect the delivery ports of the plurality of open-circuit pumps 14 and 15 to the tank 25; the cap pressure sensor 60*a* that senses the pressure in the cap chamber 3*a*; the rod pressure sensor 60*b* that senses the pressure in the rod chamber 3*b* of the single rod hydraulic cylinder 3; and the controller 51 that controls the plurality of closed-circuit selector valves 40 to 43, and the plurality of cap-side selector valves 44 and 46, and controls the delivery flow rate of each of the plurality of closed-circuit pumps 12 and 13 and the plurality of open-circuit pumps 14 and 15, and the opening areas of the plurality of proportional valves 48 and 49 on the basis of inputs from the operation device 52, the cap pressure sensor 60*a* and the rod pressure sensor 60*b*, the construction machine 100 includes the plurality of rod-side selector valves 45 and 47 that connect the delivery ports of the plurality of open-circuit pumps 14 and 15 to the rod chamber 3*b*, and the controller 51 controls the cap-side selector valve 46 and the plurality of rod-side selector valves 47 such that the particular open-circuit pump 15 in the plurality of open-circuit pumps 14 and 15 that is not connected to the single rod hydraulic cylinder 3 is connected to the single rod hydraulic cylinder, and controls the opening area of the particular proportional valve 49 provided on the flow line that connects the delivery port of the particular open-circuit pump 15 to the tank 25, when the single rod hydraulic cylinder 3 and the hydraulic motor 7 are driven simultaneously.

According to the thus-configured present embodiment, when the single rod hydraulic cylinder 3 and the hydraulic motor 7 are driven simultaneously, the particular open-circuit pump 15 not connected to the single rod hydraulic cylinder 3 and the particular proportional valve 49 are connected to the single rod hydraulic cylinder 3, and the opening area of the particular proportional valve 49 provided on the flow line that connects the delivery port of the particular open-circuit pump 15 to the tank 25 is controlled. Thereby, when the single rod hydraulic cylinder 3 and the hydraulic motor 7 are driven simultaneously, it becomes possible to use the unused open-circuit pump 15 or the unused proportional valve 49 to accelerate the speed of the single rod hydraulic cylinder 3.

In addition, the hydraulic excavator 100 according to the present embodiment further includes: the charge pump 11; the charge line 212 connected to the delivery port of the charge pump 11; the charge relief valve 20 provided on the charge line 212; and a charge pressure sensor 62 that senses the pressure in the charge line 212, and the controller 51 controls the cap-side selector valve 46 and the rod-side selector valve 47 such that the particular open-circuit pump 15 gets connected to the cap chamber 3*a*, opens the particular proportional valve 49, and reduces the opening area of the particular proportional valve 49 when the pressure in the charge line 212 falls below the predetermined pressure P set lower than the set pressure of the charge relief valve 20, in a case in which the hydraulic motor 7 is driven at the same time that the single rod hydraulic cylinder 3 is driven toward the extension side in a state in which the pressure in the rod chamber 3*b* is higher than the pressure in the cap chamber 3*a*. Thereby, the hydraulic operating fluid is supplied from the open-circuit pump 14 to the low-pressure-side cap chamber 3*a* of the single rod hydraulic cylinder 3, and, while the pressure in the charge line 212 is kept at the predetermined pressure P or higher, the hydraulic operating fluid in the high-pressure-side rod chamber 3*b* of the single rod hydraulic cylinder 3 is discharged to the tank 25 via the unused proportional valve 49. Accordingly, it becomes possible to accelerate the extension speed of the single rod hydraulic cylinder 3 while the pressure in the cap chamber 3*a* is prevented from becoming a negative pressure.

Second Embodiment

Figure 6:
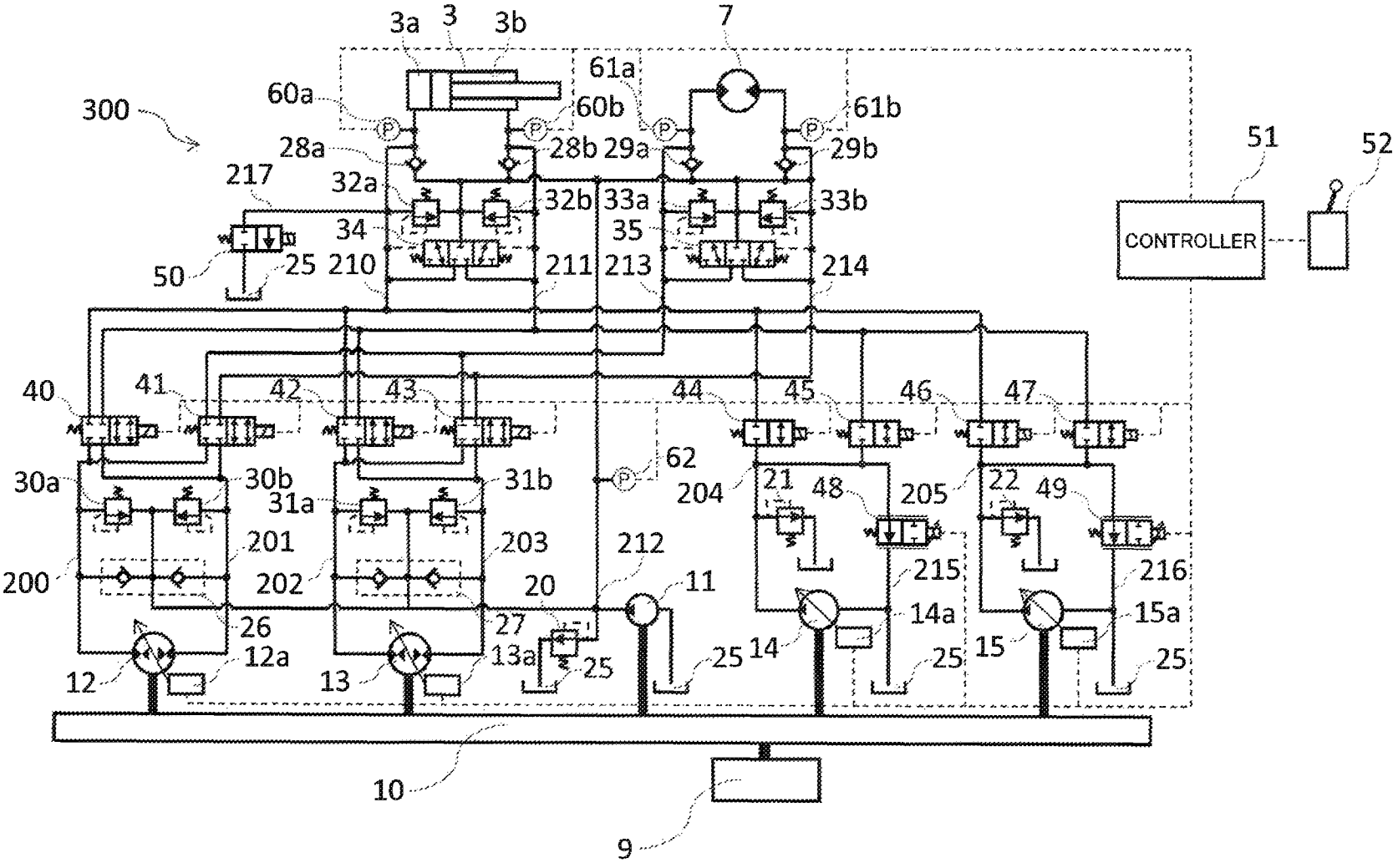
FIG. 6 is a schematic configuration diagram of the hydraulic system according to a second embodiment of the present invention.
Figure 7A:
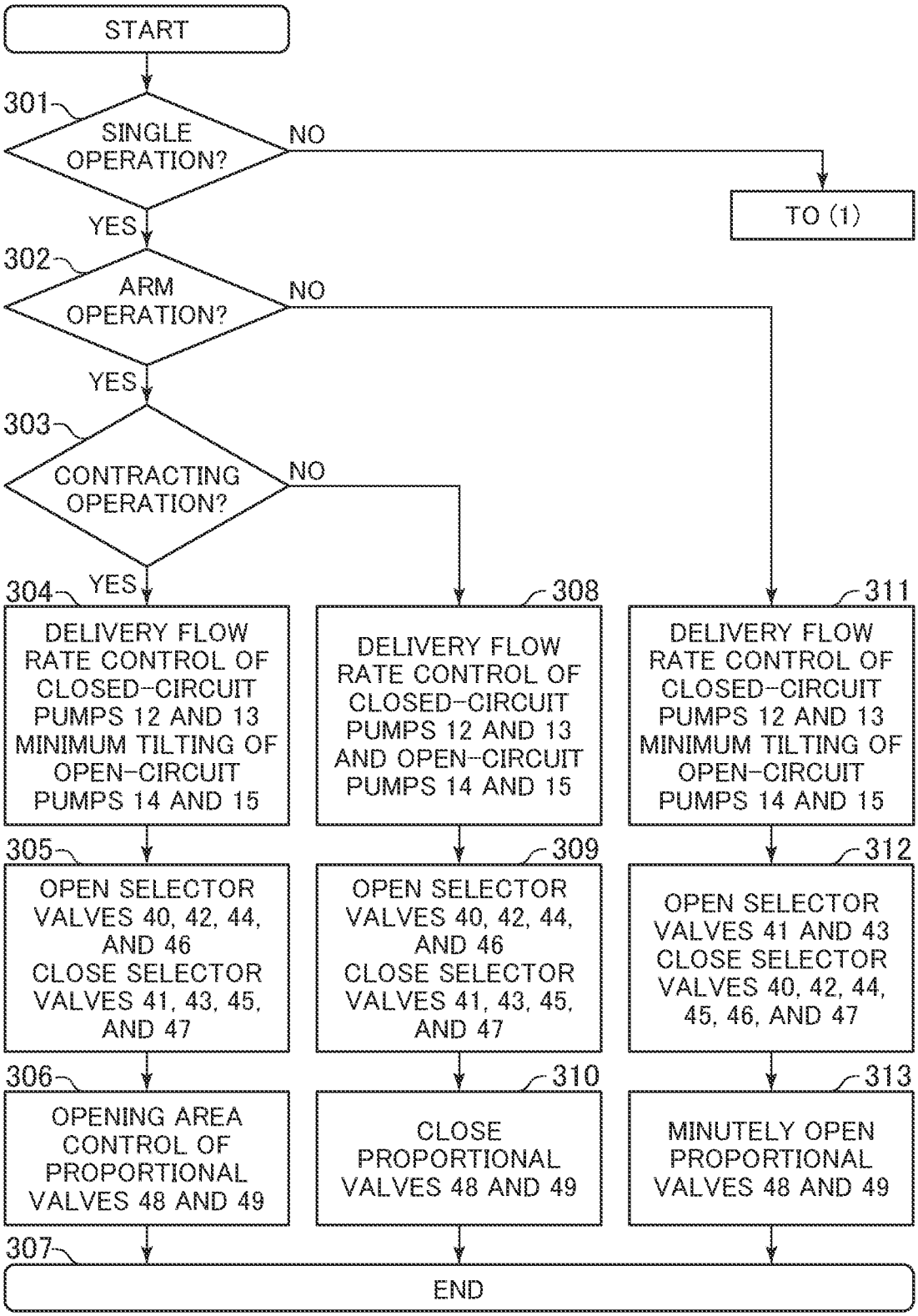
FIG. 7A is a figure (1/2) illustrating a control flow of the actuator-flow-rate-allocation calculating section according to the second embodiment of the present invention.
Figure 7B:
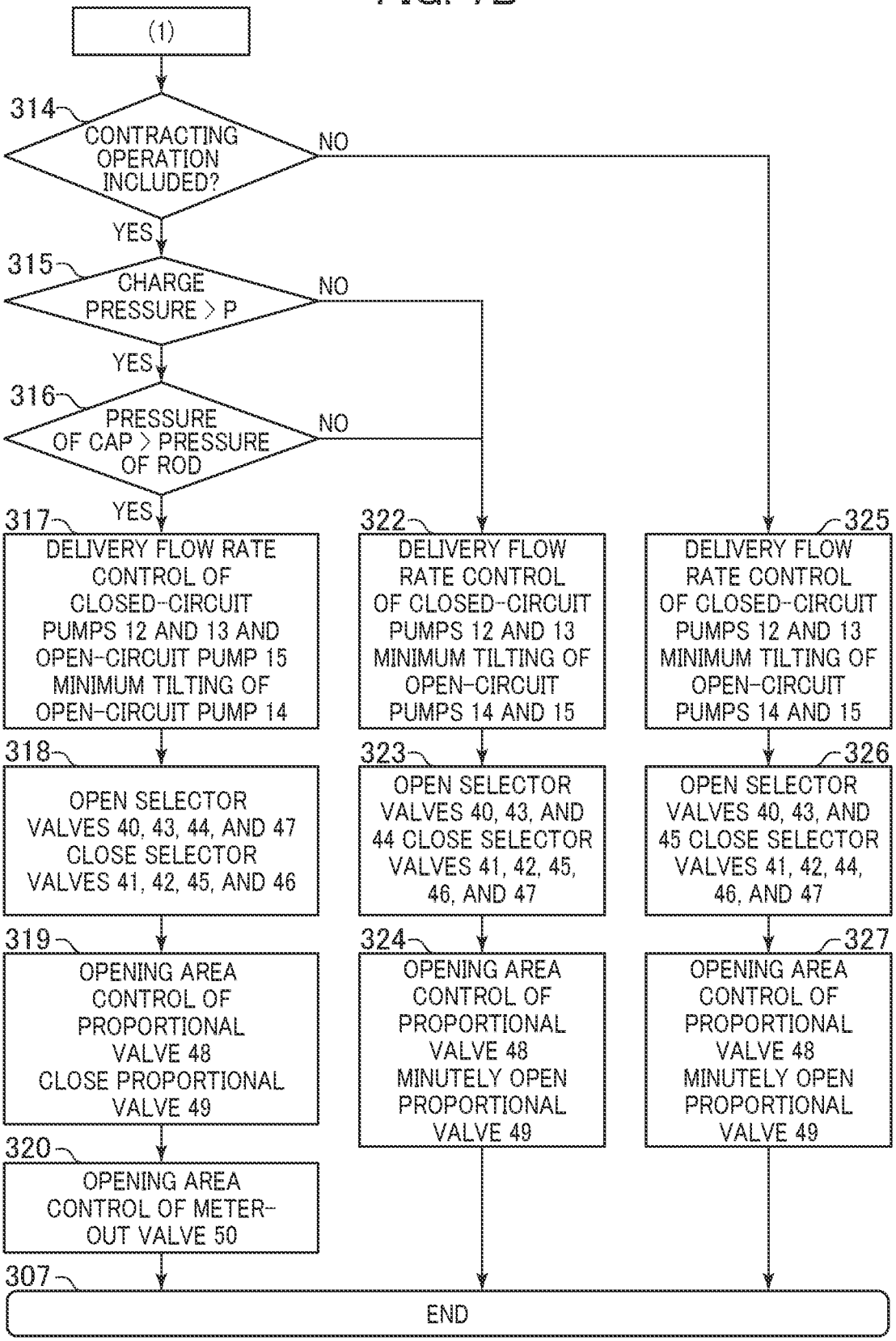
FIG. 7B is a figure (2/2) illustrating the control flow of the actuator-flow-rate-allocation calculating section according to the second embodiment of the present invention.
Figure 8:
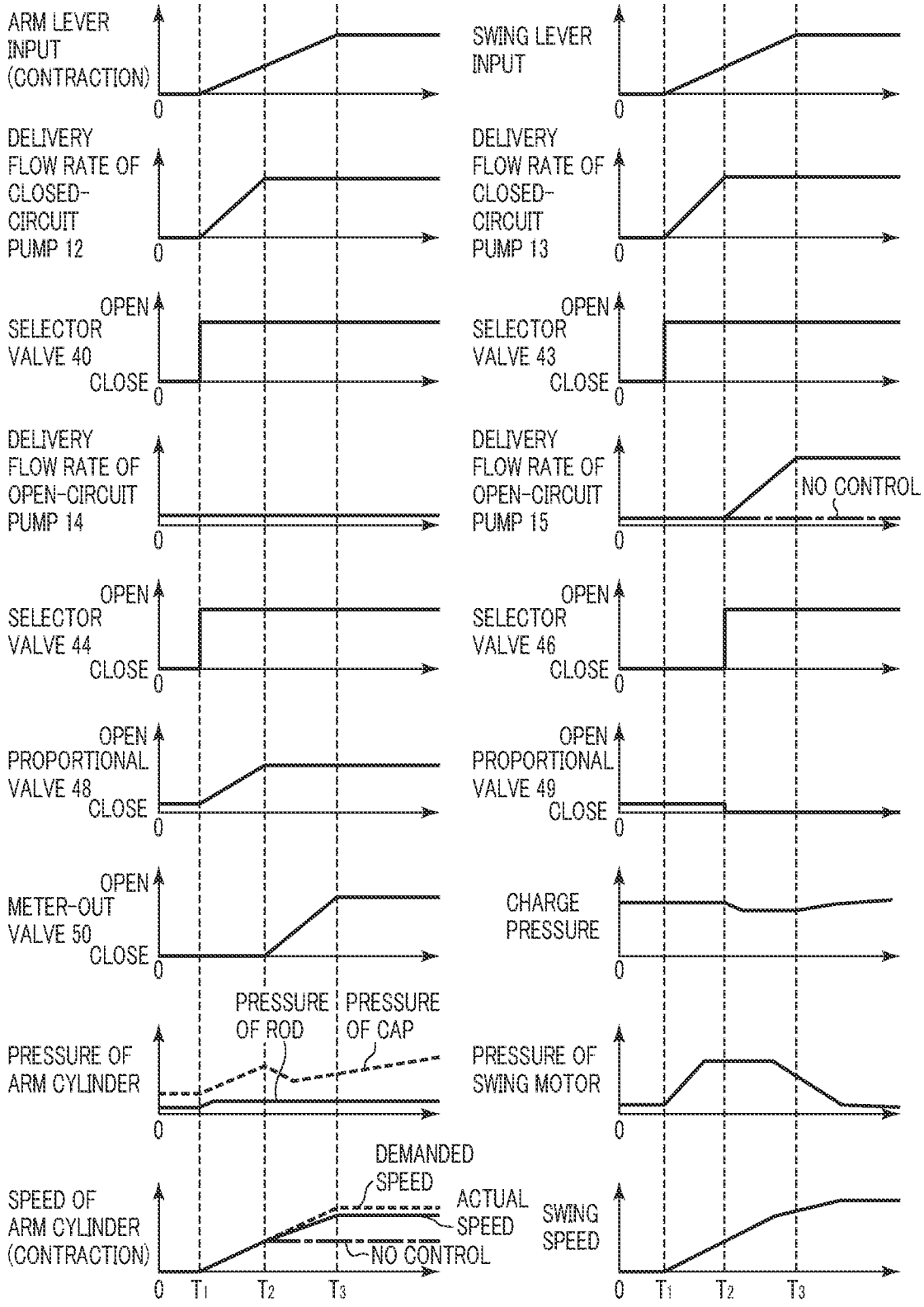
FIG. 8 is a figure illustrating operation of the hydraulic system in a case in which control illustrated in FIG. 7A

The hydraulic excavator according to the second embodiment of the present invention is explained by using FIG. 6 to FIG. 8.

FIG. 6 is a schematic configuration diagram of the hydraulic system according to the present embodiment.

In FIG. 6, the hydraulic system according to the present embodiment further includes: a cap-side discharge flow line 217 that connects the cap chamber 3*a* of the single rod hydraulic cylinder 3 to the tank 25; and the meter-out valve 50 provided on the cap-side discharge flow line 217.

FIG. 7A and FIG. 7B illustrate a control flow of the actuator-allocated-flow-rate calculating section 51*c* (illustrated in FIG. 3) according to the present embodiment.

When input of operation through the lever 52 is started, it is determined whether or not the operation is single operation at Step 301. When the operation is single operation, it is determined whether or not the operation is arm operation at Step 302. When the operation is arm operation, it is determined whether or not the operation is arm-contracting operation at Step 303. When the operation is arm-contracting operation, at Step 304, the delivery flow rates of the closed-circuit pumps 12 and 13 are controlled, and the delivery flow rates of the open-circuit pumps 14 and 15 are controlled such that the tilting amounts are minimized. At Step 305, the selector valves 40, 42, 44, and 46 are opened, and the selector valves 41, 43, 45, and 47 are closed. At Step 306, the opening areas of the proportional valves 48 and 49 are controlled, and the flow ends at Step 307.

As a result of Steps 304 to 306, the hydraulic operating fluid is supplied from the closed-circuit pumps 12 and 13 to the rod chamber 3*b* of the arm cylinder 3, part of the hydraulic operating fluid discharged from the cap chamber 3*a* of the arm cylinder 3 is absorbed by the closed-circuit pumps 12 and 13, remaining part of the hydraulic operating fluid is discharged to the tank 25 via the proportional valves 48 and 49, and the arm cylinder 3 performs contracting operation.

When it is determined at Step 303 that the operation is not arm-contracting operation, at Step 308, the delivery flow rates of the closed-circuit pumps 12 and 13, and the open-circuit pumps 14 and 15 are controlled. At Step 309, the selector valves 40, 42, 44, and 46 are opened, and the selector valves 41, 43, 45, and 47 are closed. At Step 310, the proportional valves 48 and 49 are closed, and the flow ends at Step 307.

As a result of Steps 308 to 310, the hydraulic operating fluid delivered from the closed-circuit pumps 12 and 13 and the open-circuit pumps 14 and 15 is supplied to the cap chamber 3*a* of the arm cylinder 3, the hydraulic operating fluid discharged from the rod chamber 3*b* of the arm cylinder 3 is absorbed by the closed-circuit pumps 12 and 13, and the arm cylinder 3 performs extending operation.

When it is determined at Step 302 that the operation is not arm operation (i.e. the operation is swing single operation), at Step 311, the delivery flow rates of the closed-circuit pumps 12 and 13 are controlled, and the delivery flow rates of the open-circuit pumps 14 and 15 are controlled such that the tilting amounts are minimized. At Step 312, the selector valves 41 and 43 are opened, and the selector valves 40, 42, 44, 45, 46, and 47 are closed. At Step 313, the proportional valves 48 and 49 are opened minutely, and the flow ends at Step 307.

As a result of Steps 311 to 313, the hydraulic operating fluid delivered from the closed-circuit pumps 12 and 13 is supplied to the one input/output port of the swing motor 7, the hydraulic operating fluid discharged from the other input/output port of the swing motor 7 is absorbed by the closed-circuit pumps 12 and 13, and the swing motor 7 performs rotational operation.

When it is determined at Step 301 that the operation is not single operation (i.e. the operation is combined operation), it is determined whether or not the operation includes arm-contracting operation at Step 314. When it is determined that the operation includes arm-contracting operation, it is determined whether or not the charge pressure is higher than the predetermined pressure P at Step 315. When it is determined at Step 315 that the charge pressure is higher than the predetermined pressure P, it is determined whether or not the pressure in the cap chamber 3*a* of the arm cylinder 3 is higher than the pressure in the rod chamber 3*b* at Step 316. When it is determined that the pressure in the cap chamber 3*a* is higher, at Step 317, the delivery flow rates of the closed-circuit pumps 12 and 13 and the open-circuit pump 15 are controlled, and the delivery flow rate of the open-circuit pump 14 is controlled such that the tilting amount is minimized. At Step 318, the selector valves 40, 43, 44, and 47 are opened, and the selector valves 41, 42, 45, and 46 are closed. At Step 319, the opening area of the proportional valve 48 is controlled, and the proportional valve 49 is closed. At Step 320, the opening area of the meter-out valve 50 is controlled. At Step 307, the flow ends.

As a result of Steps 317 to 320, the hydraulic operating fluid is supplied from the closed-circuit pump 12 and the open-circuit pump 15 to the rod chamber 3*b* of the arm cylinder 3, part of the hydraulic operating fluid discharged from the cap chamber 3*a* of the arm cylinder 3 is absorbed by the closed-circuit pump 12, remaining part of the hydraulic operating fluid is discharged to the tank 25 via the proportional valve 48 and the meter-out valve 50, and the arm cylinder 3 performs contracting operation. Simultaneously, the hydraulic operating fluid is supplied from the closed-circuit pump 13 to the one input/output port of the swing motor 7, the hydraulic operating fluid discharged from the other input/output port of the swing motor 7 is absorbed by the closed-circuit pump 13, and the swing motor 7 performs rotational operation. At this time, the hydraulic operating fluid in the high-pressure-side cap chamber 3*a* of the arm cylinder 3 is discharged to the tank 25 via the proportional valve 48 and the meter-out valve 50, and the low-pressure-side rod chamber 3*b* is supplemented with the hydraulic operating fluid from the unused open-circuit pump 15. Accordingly, it becomes possible to accelerate the contraction speed of the arm cylinder 3 while the pressure in the rod chamber 3*b* is prevented from becoming a negative pressure.

When it is determined at Step 316 that the pressure in the cap chamber 3*a* is not higher than the pressure in the rod chamber 3*b*, or when it is determined at Step 315 that the charge pressure is not higher than the predetermined pressure P, at Step 322, the delivery flow rates of the closed-circuit pumps 12 and 13 are controlled, and the delivery flow rates of the open-circuit pumps 14 and 15 are controlled such that the tilting amounts are minimized. At Step 323, the selector valves 40, 43, and 44 are opened, and the selector valves 41, 42, 45, 46, and 47 are closed. At Step 324, the opening area of the proportional valve 48 is controlled, and the proportional valve 49 is opened minutely, and the flow ends at Step 307. Thereby, the hydraulic operating fluid is supplied from the closed-circuit pump 12 to the rod chamber 3*b* of the arm cylinder 3, part of the hydraulic operating fluid discharged from the cap chamber 3*a* of the arm cylinder 3 is absorbed by the closed-circuit pump 12, remaining part of the hydraulic operating fluid is discharged to the tank 25 via the proportional valve 48, and the arm cylinder 3 performs contracting operation. Simultaneously, the hydraulic operating fluid is supplied from the closed-circuit pump 13 to the one input/output port of the swing motor 7, the hydraulic operating fluid discharged from the other input/output port of the swing motor 7 is absorbed by the closed-circuit pump 13, and the swing motor 7 performs rotational operation.

When it is determined at Step 314 that the operation does not include arm-contracting operation, at Step 325, the delivery flow rates of the closed-circuit pumps 12 and 13 are controlled, and the delivery flow rates of the open-circuit pumps 14 and 15 are controlled such that the tilting amounts are minimized. At Step 326, the selector valves 40, 43 and 45 are opened, and the selector valves 41, 42, 44, 45, 46, and 47 are closed. At Step 327, the opening area of the proportional valve 48 is controlled, and the proportional valve 49 is closed minutely, and the flow ends at Step 307.

As a result of Steps 325 to 327, the hydraulic operating fluid is supplied from the closed-circuit pump 12 to the cap chamber 3*a* of the arm cylinder 3, part of the hydraulic operating fluid discharged from the rod chamber 3*b* of the arm cylinder 3 is absorbed by the closed-circuit pump 12, remaining part of the hydraulic operating fluid is discharged to the tank 25 via the proportional valve 48, and the arm cylinder 3 performs extending operation. Simultaneously, the hydraulic operating fluid is supplied from the closed-circuit pump 13 to the one input/output port of the swing motor 7, the hydraulic operating fluid discharged from the other input/output port of the swing motor 7 is absorbed by the closed-circuit pump 13, and the swing motor 7 performs rotational operation.

FIG. 8 illustrates operation of the hydraulic system 300 in a case in which the control flow illustrated in FIG. 7A and FIG. 7B is executed. Similarly to the first embodiment, combined operation of simultaneously operating the arm 4 and the upper swing structure 102 is explained as an example.

FIG. 8 illustrates: input through the lever 52; the delivery flow rates of the closed-circuit pumps 12 and 13; the opened/closed states of the selector valves 40 and 43; the delivery flow rates of the open-circuit pumps 14 and 15; the opened/closed states of the selector valves 44 and 46; the openings of the proportional valves 48 and 49; the opening of the meter-out valve 50; the charge pressure; the pressure in the arm cylinder 3; the pressure in the swing motor 7; the speed of the arm cylinder 3; and the speed of the swing motor 7, that are observed when dual combined operation of arm and swing operation (arm dumping, swing) is performed.

When operation of the lever 52 is started by an operator at time T1, the delivery flow rates of the closed-circuit pumps 12 and 13 increase according to the input through the lever 52. At this time, the selector valve 40 becomes opened in order to form a flow line to the arm cylinder 3, and the selector valve 43 becomes opened in order to form a flow line to the swing motor 7. The other selector valves 41 and 42 on the side of the closed-circuit pumps are in the closed state. Since the operation is operation to contract the arm cylinder 3, the open-circuit pump 14 is not delivering the hydraulic operating fluid, the selector valve 44 is opened, the opening area of the proportional valve 48 is controlled, and the hydraulic operating fluid discharged from the arm cylinder 3 is being discharged from the proportional valve 48 to the tank 25. Since the open-circuit pump 15 is not used for the swing motor 7, the delivery flow rate is controlled such that the tilting amount is minimized. In order to discharge the hydraulic operating fluid at the minimum delivery flow rate from the open-circuit pump 15 to the tank 25, the proportional valve 49 opens minutely.

At time T2, the delivery flow rates of the closed-circuit pumps 12 and 13 become the maximum delivery flow rates. At this time, the speed of the arm cylinder 3 has not satisfied the demanded speed. Since the pressure in the cap chamber 3*a* of the arm cylinder 3 is a pressure higher than the pressure in the rod chamber 3*b*, in order to increase the speed of the arm cylinder 3, it is necessary to increase the flow rate of the hydraulic operating fluid discharged from the cap chamber 3*a* of the arm cylinder 3.

At time T2, the meter-out valve 50 is opened, a flow line is formed between the cap chamber 3*a* of the arm cylinder 3 and the tank 25, and the hydraulic operating fluid from the cap chamber 3*a* is discharged to the tank 25. At this time, in order to prevent the hydraulic operating fluid in the circuit from becoming insufficient, and prevent the charge pressure from lowering, the selector valve 47 is opened, and the hydraulic operating fluid is delivered from the open-circuit pump 15 to the rod chamber 3*b* of the arm cylinder 3.

The construction machine 100 according to the present embodiment further includes:

the cap-side discharge flow line 217 that connects the cap chamber 3*a* of the single rod hydraulic cylinder 3 to the tank 25; and the meter-out valve 50 provided on the cap-side discharge flow line 217, and the controller 51 controls the cap-side selector valve 46 and the rod-side selector valve 47 such that the particular open-circuit pump 15 gets connected to the rod chamber 3*b*, closes the particular proportional valve 49 corresponding to the particular open-circuit pump 15, opens the meter-out valve 50, and reduces the opening area of the meter-out valve 50 or increases the delivery flow rate of the particular open-circuit pump 15 when the pressure in the charge line 212 falls below the predetermined pressure P set lower than the set pressure of the charge relief valve 20, in a case in which swing motor 7 is driven at the same time that the arm cylinder 3 is driven toward the contraction side in a state in which the pressure in the cap chamber 3*a* is higher than the pressure in the rod chamber 3*b*.

According to the thus-configured present embodiment, while the pressure in the charge line 212 is kept at the predetermined pressure P or higher, the hydraulic operating fluid in the high-pressure-side cap chamber 3*a* of the single rod hydraulic cylinder 3 is discharged to the tank 25 via the proportional valve 48 and the meter-out valve 50, and the low-pressure-side rod chamber 3*b* is supplemented with the hydraulic operating fluid from the unused open-circuit pump 15. Accordingly, it becomes possible to accelerate the contraction speed of the single rod hydraulic cylinder 3 while the pressure in the rod chamber 3*b* is prevented from becoming a negative pressure.

Note that while the discharge from the cap chamber 3*a* of the single rod hydraulic cylinder 3 is performed with the meter-out valve 50, and the delivery flow rate of the open-circuit pump 15 is controlled such that the hydraulic operating fluid is introduced to the rod chamber 3*b* of the single rod hydraulic cylinder 3 in the present embodiment, the following configuration may be adopted when there is not the meter-out valve 50.

The controller 51 controls the cap-side selector valve 46 and the rod-side selector valve 47 such that the particular proportional valve 49 is connected to the cap chamber 3*a*, opens the particular proportional valve 49, and reduces the opening area of the particular proportional valve 49 when the pressure in the charge line 212 falls below the predetermined pressure P set lower than the set pressure of the charge relief valve 20, in a case in which the hydraulic motor 7 is driven at the same time that the single rod hydraulic cylinder 3 is driven toward the contraction side in a state in which the pressure in the cap chamber 3*a* is higher than the pressure in the rod chamber 3*b*. Thereby, while the pressure in the charge line 212 is kept at the predetermined pressure P or higher, the hydraulic operating fluid in the high-pressure-side cap chamber 3*a* of the single rod hydraulic cylinder 3 is discharged to the tank 25 via the unused proportional valve 49. Accordingly, it becomes possible to accelerate the contraction speed of the single rod hydraulic cylinder 3 while the pressure in the rod chamber 3*b* is prevented from becoming a negative pressure.

Although embodiments of the present invention are described in detail thus far, the present invention is not limited to the embodiments described above, and includes various modification examples. For example, the embodiments described above are explained in detail for explaining the present invention in an easy-to-understand manner, and are not necessarily limited to those including all the configurations explained. Furthermore, it is also possible to add some of configurations of an embodiment to configurations of another embodiment, and it is also possible to remove some of configurations of an embodiment or to replace some of configurations of an embodiment with part of another embodiment.

DESCRIPTION OF REFERENCE CHARACTERS

1: Boom cylinder
2: Boom
3: Arm cylinder
3*a*: Cap chamber
3*b*: Rod chamber
4: Arm
5: Bucket cylinder
6: Bucket
7: Swing motor
8: Travel device
10: Power transmission device
11: Charge pump
12: Closed-circuit pump
12*a*: Regulator
13: Closed-circuit pump
13*a*: Regulator
14: Open-circuit pump
14*a*: Regulator
15: Open-circuit pump
15*a*: Regulator
20: Charge relief valve
25: Tank
26, 27, 28*a*, 28*b*, 29*a*, 29*b*: Charge check valve
30*a*, 30*b*, 31*a*, 31*b*, 32*a*, 32*b*, 33*a*, 33*b*: Relief valve
34, 35: Flushing valve
40 to 43: Closed-circuit selector valve
44, 46: Cap-side selector valve
45, 47: Rod-side selector valve
48, 49: Proportional valve
50: Meter-out valve
51: Controller
51*a*: Demanded-speed calculating section
51*b*: Charge-pressure calculating section
51*c*: Actuator-allocated-flow-rate calculating section
51*d*: Pump-signal output section
51*e*: Selector-valve-signal output section
51*f*: Proportional-valve-signal output section
51*g*: Meter-out-valve-signal output section
52: Lever (operation device)
60*a*: Pressure sensor (cap pressure sensor)
60*b*: Pressure sensor (rod pressure sensor)
61*a*, 61*b*: Pressure sensor
62: Charge pressure sensor
100: Hydraulic excavator (construction machine)
101: Cab
102: Upper swing structure
103: Lower travel structure
104: Front work implement
200 to 205, 210, 211: Flow line
212: Flow line (charge line)
213 to 216: Flow line
217: Cap-side discharge flow line
300: Hydraulic system

The invention claimed is:

1. A construction machine, comprising:

a tank that stores hydraulic operating fluid;

a plurality of closed-circuit pumps including bidirectionally-tiltable hydraulic pumps;

a plurality of open-circuit pumps including unidirectionally-tiltable hydraulic pumps, the number of the unidirectionally-tiltable hydraulic pumps being same as the number of the plurality of closed-circuit pumps;

a plurality of hydraulic actuators including at least one single rod hydraulic cylinder, and at least one hydraulic motor;

an operation device for giving an instruction about operation of the plurality of hydraulic actuators;

a plurality of closed-circuit selector valves that connect the plurality of closed-circuit pumps to the plurality of hydraulic actuators such that closed circuits are formed;

a plurality of cap-side selector valves that connect delivery ports of the plurality of open-circuit pumps to a cap chamber of the single rod hydraulic cylinder;

a plurality of proportional valves that are provided on flow lines that connect the delivery ports of the plurality of open-circuit pumps to the tank;

a cap pressure sensor that senses a pressure in the cap chamber;

a rod pressure sensor that senses a pressure in a rod chamber of the single rod hydraulic cylinder;

a controller that controls the plurality of closed-circuit selector valves and the plurality of cap-side selector valves, and controls a delivery flow rate of each of the plurality of closed-circuit pumps and the plurality of open-circuit pumps, and opening areas of the plurality of proportional valves, on a basis of inputs from the operation device, the cap pressure sensor, and the rod pressure sensor; and a plurality of rod-side selector valves that connect the delivery ports of the plurality of open-circuit pumps to the rod chamber, a cap-side discharge flow line that connects the cap chamber to the tank; and a meter-out valve provided on the cap-side discharge flow line, wherein the controller is configured to, in a case where the single rod hydraulic cylinder and the hydraulic motor are driven simultaneously, control the plurality of cap-side selector valves and the plurality of rod-side selector valves such that a particular open-circuit pump in the plurality of open-circuit pumps that is not connected to the single rod hydraulic cylinder gets connected with the single rod hydraulic cylinder, and control an opening area of a particular proportional valve provided on a flow line that connects a delivery port of the particular open-circuit pump to the tank;

wherein the controller is configured to, in a case where the hydraulic motor is driven at a same time that the single rod hydraulic cylinder is operated toward a contraction side, control the plurality of cap-side selector valves and the plurality of rod-side selector valves such that the particular open-circuit pump is connected to the rod chamber, close the particular proportional valve, and open the meter-out valve;

wherein the construction machine further comprises:

a charge pump;

a charge line connected to a delivery port of the charge pump;

a charge relief valve provided on the charge line; and a charge pressure sensor that senses a pressure in the charge line, wherein the controller is further configured to, in a case where the hydraulic motor is driven at a same time that the single rod hydraulic cylinder is driven toward the contraction side in a state where the pressure in the cap chamber is higher than the pressure in the rod chamber, control the plurality of cap-side selector valves and the plurality of rod-side selector valves such that the particular open-circuit pump gets connected to the rod chamber, close the particular proportional valve, open the meter-out valve, and reduce an opening area of the meter-out valve when the pressure in the charge line falls below a predetermined pressure set lower than a set pressure of the charge relief valve.

2. A construction machine, comprising:

a tank that stores hydraulic operating fluid;

a plurality of closed-circuit pumps including bidirectionally-tiltable hydraulic pumps;

a plurality of open-circuit pumps including unidirectionally-tiltable hydraulic pumps, the number of the unidirectionally-tiltable hydraulic pumps being same as the number of the plurality of closed-circuit pumps;

a plurality of hydraulic actuators including at least one single rod hydraulic cylinder, and at least one hydraulic motor;

an operation device for giving an instruction about operation of the plurality of hydraulic actuators;

a plurality of closed-circuit selector valves that connect the plurality of closed-circuit pumps to the plurality of hydraulic actuators such that closed circuits are formed;

a plurality of cap-side selector valves that connect delivery ports of the plurality of open-circuit pumps to a cap chamber of the single rod hydraulic cylinder;

a plurality of proportional valves that are provided on flow lines that connect the delivery ports of the plurality of open-circuit pumps to the tank;

a cap pressure sensor that senses a pressure in the cap chamber;

a rod pressure sensor that senses a pressure in a rod chamber of the single rod hydraulic cylinder;

a controller that controls the plurality of closed-circuit selector valves and the plurality of cap-side selector valves, and controls a delivery flow rate of each of the plurality of closed-circuit pumps and the plurality of open-circuit pumps, and opening areas of the plurality of proportional valves, on a basis of inputs from the operation device, the cap pressure sensor, and the rod pressure sensor; and a plurality of rod-side selector valves that connect the delivery ports of the plurality of open-circuit pumps to the rod chamber, a cap-side discharge flow line that connects the cap chamber to the tank; and a meter-out valve provided on the cap-side discharge flow line, wherein the controller is configured to, in a case where the single rod hydraulic cylinder and the hydraulic motor are driven simultaneously, control the plurality of cap-side selector valves and the plurality of rod-side selector valves such that a particular open-circuit pump in the plurality of open-circuit pumps that is not connected to the single rod hydraulic cylinder gets connected with the single rod hydraulic cylinder, and control an opening area of a particular proportional valve provided on a flow line that connects a delivery port of the particular open-circuit pump to the tank;

wherein the controller is configured to, in a case where the hydraulic motor is driven at a same time that the single rod hydraulic cylinder is operated toward a contraction side, control the plurality of cap-side selector valves and the plurality of rod-side selector valves such that the particular open-circuit pump is connected to the rod chamber, close the particular proportional valve, and open the meter-out valve;

wherein the construction machine further comprises:

a charge pump;

a charge line connected to a delivery port of the charge pump;

a charge relief valve provided on the charge line; and a charge pressure sensor that senses a pressure in the charge line, wherein the controller is further configured to, in a case where the hydraulic motor is driven at a same time that the single rod hydraulic cylinder is driven toward the contraction side in a state where the pressure in the cap chamber is higher than the pressure in the rod chamber, control the plurality of cap-side selector valves and the plurality of rod-side selector valves such that the particular open-circuit pump gets connected to the rod chamber, close the particular proportional valve, open the meter-out valve, and increase a delivery flow rate of the particular open-circuit pump in a case where the pressure in the charge line falls below a predetermined pressure set lower than a set pressure of the charge relief valve.

3. A construction machine, comprising:

a tank that stores hydraulic operating fluid;

a plurality of closed-circuit pumps including bidirectionally-tiltable hydraulic pumps;

a plurality of open-circuit pumps including unidirectionally-tiltable hydraulic pumps, the number of the unidirectionally-tiltable hydraulic pumps being same as the number of the plurality of closed-circuit pumps;

a plurality of hydraulic actuators including at least one single rod hydraulic cylinder, and at least one hydraulic motor;

an operation device for giving an instruction about operation of the plurality of hydraulic actuators;

a plurality of closed-circuit selector valves that connect the plurality of closed-circuit pumps to the plurality of hydraulic actuators such that closed circuits are formed;

a plurality of cap-side selector valves that connect delivery ports of the plurality of open-circuit pumps to a cap chamber of the single rod hydraulic cylinder;

a plurality of proportional valves that are provided on flow lines that connect the delivery ports of the plurality of open-circuit pumps to the tank;

a cap pressure sensor that senses a pressure in the cap chamber;

a rod pressure sensor that senses a pressure in a rod chamber of the single rod hydraulic cylinder;

a controller that controls the plurality of closed-circuit selector valves and the plurality of cap-side selector valves, and controls a delivery flow rate of each of the plurality of closed-circuit pumps and the plurality of open-circuit pumps, and opening areas of the plurality of proportional valves, on a basis of inputs from the operation device, the cap pressure sensor, and the rod pressure sensor; and a plurality of rod-side selector valves that connect the delivery ports of the plurality of open-circuit pumps to the rod chamber, wherein the controller is configured to, in a case where the single rod hydraulic cylinder and the hydraulic motor are driven simultaneously, control the plurality of cap-side selector valves and the plurality of rod-side selector valves such that a particular open-circuit pump in the plurality of open-circuit pumps that is not connected to the single rod hydraulic cylinder gets connected with the single rod hydraulic cylinder, and control an opening area of a particular proportional valve provided on a flow line that connects a delivery port of the particular open-circuit pump to the tank;

wherein the construction machine further comprises:

a charge pump;

a charge line connected to a delivery port of the charge pump;

a charge relief valve provided on the charge line; and a charge pressure sensor that senses a pressure in the charge line, wherein the controller is further configured to, in a case where the hydraulic motor is driven at a same time that the single rod hydraulic cylinder is driven toward an extension side in a state where the pressure in the rod chamber is higher than the pressure in the cap chamber, control the plurality of cap-side selector valves and the plurality of rod-side selector valves such that the particular open-circuit pump gets connected to the rod chamber, open the particular proportional valve, and reduce an opening area of the particular proportional valve when the pressure in the charge line falls below a predetermined pressure set lower than a set pressure of the charge relief valve.

* * * * *